US005525450A

United States Patent [19]

Spiewak et al.

[11] Patent Number: 5,525,450

[45] Date of Patent: Jun. 11, 1996

[54] LIQUID DEVELOPER COMPOSITIONS WITH MULTIPLE BLOCK COPOLYMERS

[75] Inventors: John W. Spiewak, Webster; James R. Larson, Fairport; Scott D. Chamberlain, Macedon, all of N.Y.

[73] Assignee: Xerox Corporation, Stamford, Conn.

[21] Appl. No.: 522,908

[22] Filed: Sep. 1, 1995

[51] Int. Cl.[6] ..... G03G 9/135

[52] U.S. Cl. ..... 430/115; 430/119

[58] Field of Search ..... 430/115, 119

[56] References Cited

U.S. PATENT DOCUMENTS

| | | | |
|---|---|---|---|
| 529,653 | 3/1894 | Pearlstine | 430/115 X |
| 5,045,425 | 9/1991 | Swidler | 430/115 |
| 5,130,221 | 7/1992 | El-Sayed et al. | 430/115 X |
| 5,407,775 | 4/1995 | Larson et al. | 430/115 |
| 5,409,796 | 4/1995 | Fuller et al. | 430/115 |
| 5,411,834 | 5/1995 | Fuller et al. | 430/115 |
| 5,441,841 | 8/1995 | Larson et al. | 430/115 |

*Primary Examiner*—Roland Martin
*Attorney, Agent, or Firm*—E. O. Palazzo

[57] ABSTRACT

A liquid developer comprised of a nonpolar liquid, thermoplastic resin particles, a charge adjuvant, pigment, and a charge director selected from the group consisting of the triblock polymers BAA', BA'A, and ABA' wherein A, A' and B represent polymer segments or blocks, the polar A block repeat units contain an alkylated or protonated ammonium charged site and the polar A' block repeat units contain an acid group of a pKa equal to or less than about 7.0, and wherein the nonpolar B block repeat units contain aliphatic hydrocarbon solubilizing groups; and wherein the A and A' block number average molecular weights range from about 200 to 120,000, and the B block number average molecular weights range from about 2,000 to 190,000; and the total number average molecular weight of said charge director is from about 2,400 to about 300,000, and the ratio of $M_w$ to $M_n$ for said charge director is 1 to 5.

21 Claims, No Drawings

LIQUID DEVELOPER COMPOSITIONS WITH MULTIPLE BLOCK COPOLYMERS

BACKGROUND OF THE INVENTION

This invention is generally directed to liquid developer compositions and, more specifically, to liquid developers containing block polymer negative charge directors of the formulas BAA', BA'A, ABA' and B(AA') wherein A represents an ammonium salt, B represents a nonpolar block segment, and A' represents an acid functionality. In embodiments, the charge directors of the present invention are comprised of triblock copolymers of the formulas A—B—A', BA'A or BAA' and diblock copolymers of the formula [B(AA')=B(A'A)] wherein the polar A block is an ammonium containing block segment, B is a nonpolar block segment which, for example, provides for charge director solubility in the liquid ink fluid like ISOPAR™, and A' represents an acid functionality containing polar repeat units which can alone comprise a discrete polar block segment (A') or can be part of a multi-repeat unit (AA') polar block segment, which is randomly dispersed with the polar ammonium containing A repeat units, and wherein, for example, the A and A' blocks have a number average molecular weight range of from about 200 to about 120,000; the B blocks have a number average molecular weight range of from about 2,000 to about 190,000; the ratio of $M_w$ to $M_n$ is 1 to 5; and the total number average molecular weight of the BAA', BA'A, ABA', B(AA'), or B(A'A) copolymer is, for example, from about 2,400 to about 300,000. The developers of the present invention can be selected for a number of known imaging and printing systems, such as xerographic processes, wherein latent images are rendered visible with the liquid developers illustrated herein. The image quality, solid area coverage and resolution for developed images usually require sufficient toner particle electrophoretic mobility. The mobility for effective image development is primarily dependent on the imaging system selected. The electrophoretic mobility is primarily directly proportional to the charge on the toner particles, and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor image developer solid area coverage when insufficient toner is transferred to the final substrate and can also lead to image defects such as smears and hollowed fine features. To overcome or minimize such problems, the liquid toners of the present invention were arrived at after substantial research efforts, and which toners result in, for example, sufficient particle charge for image transfer and wherein the developer mobility is maintained within the desired range of the particular imaging system employed. Examples of specific advantages associated with the present invention include increasing the desired negative charge on the developer particles and in embodiments providing a charge director, that is superior since, for example, it provides higher charging at a comparable conductivity. –Additives like lecithin contain impurities which can have an adverse effect on their intended function. The aforementioned superior charge can result in improved image development and superior image transfer. The multiple block nature of the invention charge directors is believed to allow for more efficient micelle formation which enables higher particle charging.

Examples of acceptable conductivity and mobility ranges for developers charged with the ammonium salt, the alkylated ammonium quat, and inter-repeat unit zwitterionic block acid or acid derivative containing copolymer charge directors of the present invention are as illustrated herein. Conductivities, measured at ambient temperature (21° C. to 23° C.) for developers containing one percent toner solids are considered to be in the high range at 14 to 100 pmhos/centimeters. Medium conductivities are from about 6 to about 13 pmhos/centimeters and low conductivities are from 0.1 to about 6 pmhos/centimeters. As conductivities increase into the undesirable high range, excess ions can compete with toner particles of the same charge for development of the latent image giving rise to low developed mass resulting in low print density images. Also, with a low to medium conductivity of less than 14 pmhos/centimeter, the liquid toner or developer of this invention can possess a mobility of between about –1 to $1.99\times10^{-10}$ $m^2/Vs$ and preferably –2.00 to $2.99\times10^{-10}$ $m^2/Vs$, and most preferably –3.00 to $5\times10^{-10}$ $m^2/Vs$. Furthermore, it is desirable that these mobility ranges occur within about 8 days and preferably within 2 days of adding the charge director to the liquid toner.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured using the Horiba Capa 500 or 700 particle sizer.

Since the formation of images depends, for example, on the difference of charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors disclosed may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles of resin and optional charge adjuvant may contain pigment particles, wherein the resin can be selected from the group consisting of polyolefins, halogenated polyolefins and mixtures thereof, and in embodiments thermoplastics generally. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) of at least one of a fluoroalkylacryl ester block unit or a fluoroalkyl methacryl ester block unit, and a compatible segment (B) of a fluorine-free vinyl or olefin monomer block unit. The functional segment of the block copolymer is oriented to the surface and the compatible segment thereof is oriented to be compatible with other resins and a coloring agent contained in the toner so that the toner is provided with both liquid repelling and solvent soluble properties.

Moreover, in U.S. Pat. No. 4,707,429, the disclosure of which is totally incorporated herein by reference, there are illustrated, for example, liquid developers with an aluminum stearate charge additive. Liquid developers with charge directors are illustrated in U.S. Pat. No. 5,045,425. Additionally, of interest are U.S. Pat. Nos. 4,760,009; 5,034,299 and 5,028,508.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle, which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. Nos. 5,306,591 and 5,308,731, the disclosures of which are totally incorporated herein by reference, there is illustrated, for example, the following: a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

Illustrated in U.S. Pat. No. 5,409,796 is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment; and in U.S. Pat. No. 5,411,834 is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment.

In application U.S. Ser. No. 231,086, now U.S. Pat. No. 5,484,679 there are illustrated liquid developers with ammonium triblock copolymer charge directors preferably comprised of A and B blocks wherein A represents an ammonium salt, and B represents a nonpolar block segment.

The disclosures of each of the patents and copending applications recited herein are totally incorporated herein in their entirety.

SUMMARY OF THE INVENTION

It is an object of the present invention to provide liquid developers with many of the advantages illustrated herein.

Another object of the present invention is to provide liquid developers capable of high particle charging and fast toner charging rates.

Another object of the present invention is to provide liquid developers capable of high particle charging and fast toner charging rates at comparable charge director concentrations relative to the charging levels and rates obtained for similar AB diblock non-acid containing, charged liquid developers.

Another object of the invention is to provide a negatively charged liquid developer wherein there are selected as charge directors certain acid or acid derivative and ammonium salt containing BAA', BA'A ABA' triblock, and B(AA') diblock polymers It is still a further object of the invention to provide a liquid developer wherein developed image defects, such as image smearing, loss of resolution and loss of density, are eliminated, or minimized.

Also, in another object of the present invention there are provided negatively charged liquid developers with certain ammonium and acid or acid derivative containing BAA', BA'A or ABA' triblock polymer charge directors; and also B(AA') diblock charge directors, which are superior in embodiments to, for example, non-acid or acid derivative containing AB diblock protonated ammonium block copolymers since, for example, with the BAA∝ there results higher negative toner particle charge. A superior charge observed after two days with, for example, a 1 percent solids cyan developer charged at 5 percent charge director relative to developer solids with the protonated ammonium multiple (BAA') block copolymer charge director, poly[2-ethylhexyl methacrylate (B block)-co-N,N-dimethyl-N-ethyl methacrylate ammonium bromide (A block)-co-methacrylic acid (A'block)], was $-3.52\times10^{-10}$ $m^2/Vs$ versus $-2.99\times10^{-10}$ $m^2/Vs$ for the corresponding magenta cyan developer charged at the same level with the corresponding protonated ammonium (AB) diblock copolymer charge director of the same composition except for the absence of A' acid containing repeat units. The superior charge can result in improved image development and excellent image transfer.

Also, in another object of the present invention there are provided negatively charged liquid developers with certain inter-repeat unit zwitterionic alkylated or protonated ammonium (BAA', BA'A, ABA', B(AA') block polymer charge directors, which are superior in embodiments to, for example, protonated ammonium (AB) diblock copolymers since, for example, with the BAA', BA'A, ABA', B(AA') triblock and diblock copolymers there results higher negative particle charge. The superior charge observed after 2 days for a 1 percent solids cyan developer charged at 5 percent charge director solids relative to developer solids with the inter-repeat unit zwitterionic alkylated ammonium (BAA') triblock copolymer charge director, poly[2-ethylhexyl methacrylate (B block)-co-N,N,N-trimethyl-N-ethyl methacrylate ammonium (A block)/methacrylate (A' block) Zwitter ion-co-N,N,N-trimethyl-N-ethyl methacrylate ammonium bromide (A block)], was $-3.41\times10^{-10}$ $m^2/Vs$ versus $-2.99\times10^{-10}$ $m^2/Vs$ for the corresponding cyan developer charged at 5 percent charge director solids relative to developer solids with the protonated ammonium (AB) diblock copolymer charge director, poly[2-ethylhexyl methacrylate (B block)-co-N,N-dimethyl-N-ethyl methacrylate ammonium bromide (A block)], of the same composition except for the absence of multiple polar A' blocks. The superior charge can result in improved image development, excellent image transfer, and excellent image resolution.

Another object of the present invention resides in the provision of negatively charged liquid toners with acid and ammonium containing multiple block copolymers, and wherein in embodiments enhancement of the negative charge of NUCREL® based toners, especially cyan and magenta toners is enhanced; and which acid containing block copolymers BAA', BA'A, ABA' and B(AA') can be derived from alkylated or protonated poly [(2-ethylhexyl methacrylate (B block)-co-dimethylaminoethyl methacrylate (A block)-co-methacrylic acid (A' block)], and wherein these acid containing block copolymers can possess highly organized micelles. It is believed that the co-presence of ammonium and acid containing repeat units or acid derivative (conjugate acid anion and salt of the acid) repeat units in discrete polar A or A' block segments or in randomly mixed AA' polar block segments provide additional hydrogen bonding combinations in their respective BAA', BA'A, ABA', and B(AA') block copolymers not found in multiple block charge director copolymers comprised of only (non-acid) polar A ammonium block segments and nonpolar B block segments. The resulting increased level of hydrogen bonding and perhaps increased level of hydrogen bonding strength for some of the hydrogen bonds obtained from the co-presence of free acid or acid derivative groups and ammonium groups enables more stable micelles to form. It is further believed that more stable micelles enable higher developer charging, as measured by particle mobility, at the same charge director loading levels.

These and other objects of the present invention can be accomplished in embodiments by the provision of liquid developers with certain charge directors. In embodiments, the present invention is directed to liquid developers comprised of a liquid or carrier fluid, a thermoplastic resin, pigment, charge additive and a charge director comprised of acid or acid derivative containing ammonium block copolymers. In embodiments, the aforementioned charge director contains one or more polar ammonium A blocks, one or more nonpolar B blocks, and one or more acid or acid derivative containing polar A' blocks wherein the acid containing repeat units can comprise the polar A' block alone or can be mixed with ammonium polar A repeat units in a polar AA' mixed repeat unit block such that there is a minimum of two blocks and a maximum of ten blocks. The B block constituent or component is nonpolar thereby enabling hydrocarbon solubility. The block copolymers can be obtained from group transfer polymerization, and a subsequent polymer modification reaction of the group transfer prepared block copolymer in which the protonated or alkylated ammonium site is introduced into the polar A block. Introduction of a protonated ammonium site into the polar A block of the block copolymer by the subsequent polymer modification reaction at amine nitrogen results in a protonated BAA' or BA'A or ABA' triblock copolymer or B(AA') diblock copolymer whereas introduction of an alkylated ammonium site into the polar A block of the multiple block copolymer by the subsequent polymer modification reaction at amine nitrogen results in an alkylated BAA', BA'A or ABA' triblock copolymer or B(AA') diblock copolymer. Alkylation at the amine nitrogen comprises the first polymer modification synthetic step in route to formation of an inter-repeat unit Zwitter ion. To complete formation of the inter-repeat unit Zwitter ion, the acidic repeat unit (A') is neutralized with base to give the salt. As soon as this salt is formed, the cation from the salt site in the acid repeat unit block (A') and the anion from the alkylated ammonium site in the ammonium repeat unit block (A) combine to split out a second byproduct salt and to give the inter-repeat unit alkylated ammonium-conjugate acid Zwitter ion.

Embodiments of the present invention relate to a liquid electrostatographic developer comprised of (A) a nonpolar liquid having a Kauri-butanol value of from about 5 to about 30, and present in a major amount of from about 50 percent to about 95 weight percent; (B) thermoplastic resin particles with, for example, an average volume particle diameter of from about 0.5 to about 30 microns and preferably 1.0 to about 10 microns in average volume diameter, and pigment; (C) a BAA', BA'A or ABA' triblock copolymer or multiple repeat unit containing B(AA') diblock copolymer charge director; and (D) optionally a charge adjuvant compound.

Examples of suitable nonpolar liquid soluble charge directors selected for the developers of the present invention in various effective amounts, such as from about 0.1 to about 20 weight percent of developer solids of resin, pigment, and charge adjuvant, include ammonium BAA', BA'A or ABA' triblock copolymers and B(AA') diblock copolymers wherein the A block is the polar block containing the positive charge bearing ammonium sites, the B block is the hydrocarbon solubilizing nonpolar noncharge bearing block, and the A' block is the second polar block containing an acid functionality or a neutralized acid functionality, such as a conjugate acid anion. The polar and nonpolar blocks in the ammonium multiple block copolymers can be comprised of at least two consecutive polar repeat units or nonpolar repeat units, respectively. For example, the polar A block may comprise randomly mixed nitrogen protonated and alkylated repeat units, or two different nitrogen alkylated (methyl and propyl) repeat units when the inter-repeat unit Zwitter ion is prepared. These blocks are A blocks containing two different ammonium A repeat units and are designated as $(A_1A_2)$ blocks. Similarly, the polar A' block may comprise randomly mixed acid repeat units, such as carboxylic acid, and sulfonic acid repeat units or two different carboxylic acid repeat units. These blocks are A' blocks containing two different acidic A' repeat units and are designated as $(A'_1A'_2)$ blocks. In the B(AA') diblock copolymer charge directors of this invention, the unique polar AA' block contains both ammonium and acid, or acid derivative repeat units.

In the formation (from the A and A' blocks) of the inter-repeat unit Zwitter ions of the instant invention, the nitrogen quaternary ammonium bromide repeat units are first formed by covalently bonding a methyl (or any other suitable alkyl group) group from methyl bromide (or any other suitable alkylating agent) to the trivalent nitrogens in the poly(2-dimethylaminoethyl methacrylate) or DMAEMA repeat units contained in the A block of the BAA', BA'A or ABA' triblock base copolymer or B(AA') diblock base copolymer. The product from this first step is not yet the Zwitter ion but only the nitrogen methylareal (or alkylated) quaternary ammonium bromide (anion) species. When the second step of the inter-repeat unit Zwitter ion synthesis is effected by conversion of the acid functionality in the A' block methacrylic acid repeat units (or any other suitable acidic repeat unit) to its sodium salt (or any other suitable salt), the inter-repeat unit alkylated ammonium carboxylate Zwitter ion [or any other suitable alkylated ammonium (cation source) conjugate acid (anion source) Zwitter ion] forms rapidly and sodium bromide (or any other suitable salt byproduct) is split out. The bromide ion (or any other suitable alkylating leaving group) departs the A block and the sodium ion (or any other suitable cation in the salt) departs the B block to give sodium bromide, (or any other suitable salt product) and the inter-repeat unit Zwitter ion. When there are an equivalent number of nitrogen quaternary ammonium bromide (or any other suitable anion) repeat units in the A block and sodium (or any other suitable salt cation) methacrylate salt repeat units in the A' block, then the polar block content (A and A') will be comprised of an inter-repeat unit Zwitter ion. An exact balance of the two repeat unit types is difficult to achieve synthetically, and it is highly likely that an excess of one (A block repeat unit) or the other (A' block repeat unit) repeat units will be obtained. If the synthetic process yields an excess of either the quaternary ammonium (anions in excess) repeat units in the polar A block or the salt of the acid (cations in excess) repeat units in the polar A' block, the inter-repeat unit Zwitter ion forms to the extent that a stoichiometric balance exists between the two. Any excess of either the alkylated quaternary ammonium repeat unit with its associated anion in the polar A block or the acid-salt repeat unit with its associated cation in the polar A' block remains as a third repeat unit in its respective polar A, A' or (AA') block. The combined presence of these non-Zwitter ion repeat units with the inter-repeat unit Zwitter ion repeat units both contribute to the observed higher toner charging levels versus toner charge with block copolymer charge directors not containing free acid, or conjugate acid anion (in an inter-repeat unit Zwitter ion), or salt of an acid.

Alkylation of the amine containing repeat units in the polar A block followed by salt formation of the acid containing repeat units in the polar A' block is the preferred chemical reaction sequence for the preparation of the inter-repeat unit Zwitter ions since the possible side reaction of alkylating a first formed salt of an acid is avoided. Inter-repeat unit Zwitter ions are formed when alkylated ammonium repeat units are first generated and not when protonated ammonium repeat units are first formed because the latter would undergo neutralization (protonation reversal) when attempting to react the acid groups in the polar A' block repeat units with base during the intended salt formation step. Any suitable alkylating agents, such as illustrated herein, can be used in the nitrogen quaternization reaction and any suitable basic species, such as illustrated herein, can be used in the salt forming reaction providing that the chosen reaction conditions are not so severe as to cause side reactions leading to decomposition of any of the repeat units in the charge director block copolymer. This charge director decomposition would result in poor toner charging. Positive charge bearing polar A blocks containing at least one protonated ammonium salt or alkylated ammonium quaternized site, or at least one alkylated ammonium inter-repeat unit Zwitterionic site and neutral or negative, or positive and negative, charge bearing polar A' blocks containing at least one free acid functionality (neutral), or one conjugate acid anion (negative) functionality in an inter-repeat unit Zwitter ion, or one salt (positive cation and negative anion) of an acid functionality or combinations thereof can provide charging properties superior to the corresponding non-acid containing AB diblock copolymer charge directors.

In embodiments, the acid containing ammonium triblock copolymer charge directors and diblock copolymer charge directors are preferably comprised of A, A', or a mixed (AA') block and B blocks. Examples of A blocks are Polar A Blocks

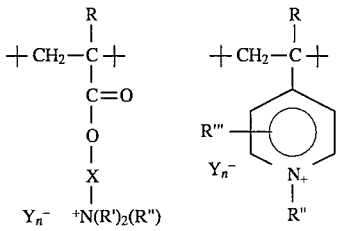

wherein R is hydrogen, alkyl of 1 to 20 carbon atoms, cycloalkyl of 3 to about 20 carbons, or aryl, alkylaryl, or cycloalkylaryl carbons for aryl; X is alkyl or cycloalkyl, aryl, alkylaryl, or cycloalkylaryl with or without heteroatoms; R' is alkyl or cycloalkyl, aryl, alkylaryl or cycloalkylaryl with or without heteroatoms; R" is hydrogen, alkyl or cycloalkyl, aryl, alkylaryl, cycloalkylaryl with or without heteroatoms; $Y^-$ is a conjugate acid anion of an acid with a pKa less than or equal to about 4.5, preferably less than 3.0 and, for example, from 0.5 to about 3; n is 0 or 1; n is 0 when the polar A' acidic repeat units contain a molar quantity of conjugate acid anion that is equal to or greater than the molar quantity of $Y^-$; n is 1 when the polar A' acidic repeat units contain a molar quantity of conjugate acid anion less than the molar quantity of $Y^-$; and R''' is alkyl or cycloalkyl, aryl, alkylaryl, or cycloalkylaryl with or without heteroatoms. Unsubstituted carbons in the pyridine ring are bonded to hydrogen. Aryl includes groups with 6 to 24 carbons, alkylaryl with 7 to 30 carbons, and cycloalkylaryl of 8 to 30 carbons.

Examples of B blocks include wherein $R^3$ is hydrogen in B and C, or saturated or unsaturated, linear or branched, alkyl or cycloalkyl of 1 to about 30 carbons in A, B, and C; or saturated or unsaturated, linear or branched, alkylaryl or cycloalkylaryl of about 10 to about 30 carbons in A, B and C with or without heteroatoms; $R^4$ is saturated or unsaturated, linear or branched, alkyl or cycloalkyl of about 4 to about 30 carbons in A, B, and C; or saturated or unsaturated, linear or branched, alkylaryl or cycloalkylaryl of about 10 to about 30 carbons in A, B, and C, with or without heteroatoms; $R^5$ is hydrogen, or saturated or unsaturated, linear or branched, alkyl or cycloalkyl of about 1 to about 30 carbons in A; or saturated or unsaturated, linear or branched, alkylaryl or cycloalkylaryl of about 10 to about 30 carbons in A, with or without heteroatoms; Z is vinylene or arylene or $R^6$ mono or disubstituted vinylene or arylene, wherein $R^6$ is hydrogen, or Blocks

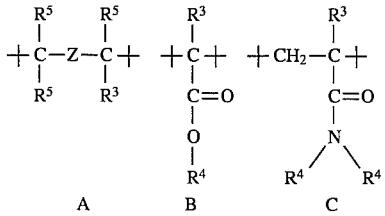

saturated or unsaturated, linear or branched, alkyl or cycloalkyl of 1 to 30 carbons; or saturated or unsaturated, linear or branched, aryl, alkylaryl or cycloalkylaryl of about 6 to about 30 carbons in A with or without heteroatoms Z, including a divalent heteroatom, such as oxygen or sulfur, in embodiments.

Examples of blocks, and more specifically, A' blocks with an acid functionality include:

Polar A' Blocks

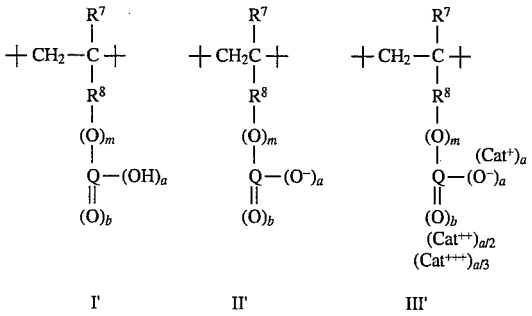

wherein Q=C, Si, S, Se, P, Ph, As; O=Oxygen; m=0 or 1; a and b=1 or 2, when a+b=2 or 3; cat/cation=an atom or cluster of atoms with at least one positive charge;

I'=repeat units containing a Bronsted acid having a pKa of <about 7 and>about −4;

II'=repeat units containing a conjugate acid from a Bronsted acid having a pKa of <about 7 and>about −4; and III'=repeat units containing an inorganic or organic salt product from the neutralization of a Bronsted acid with an inorganic or organic base wherein the Bronsted acid has a pKa of about 7 and >about −4.

The following balanced eleven (11) chemical equations generically depict the charge director repeat units obtainable (right side of equation) after nitrogen protonation or alkylation in the polar A block (Equations 1 to 2) and after acid repeat unit neutralization in the polar A' block using different starting A and A' block repeat unit ratios and different base stoichiometries (Equations 3 to 11). This equation set demonstrates the synthetic generation of the different polar A' block acid repeat units in three forms [free acid (LH), conjugate acid anion ($L^-$) of the inter-repeat unit Zwitter ion, and salt of the acid ($L^-Cat^+$)] and their coexistence with polar A block containing alkylated ammonium salt ($—N(R')_3+Y^-$) or the cation component ($—N(R')_3^+$) of the inter-repeat unit Zwitter ion, the corresponding protonated ammonium $—NH(R')_2+Y^-$ or $—NH(R')_2^+$ containing repeat units. The entire repeat unit structures are not depicted in the equation set but instead only the chemically reactive sites are illustrated. The acid and acid derivative groups were further abbreviated in the equation set such that Q and its associated oxygen atoms of the polar A' block is now entirely encompassed by the symbol L. The symbols LH, $L^-$, and $L^-Cat^+$ represent the free acid, the conjugate acid anion of the acid, and the salt of the acid, respectively. Amine and ammonium group symbols are the same as in the structures for the polar A block repeat units. The equations are balanced for monofunctional acid or acid derivative repeat units with ammonium repeat units, but similar balanced repeat unit equations can be generated when combinations of mono or multifunctional acid (or acid derivatives) repeat units and mono or multifunctional ammonium repeat units are coformulated into their respective block copolymer charge directors. The nonpolar B block is not depicted because it does not undergo any chemical changes during subsequent polymer modification chemistry such as amine protonation, amine alkylation or acid neutralization. Five different repeat units remain in various proportions in the polar A and A' blocks or in an AA' block after ammonium ion formation and acid neutralization. The type and amounts, of up to five different repeat units, depend upon the starting repeat unit molar ratio and the molar amount of base, if any, used to neutralize the acid containing repeat units.

EQUATION 1
AMINE PROTONATION AT ANY ACID BASE REPEAT UNIT RATIO WITHOUT ACID NEUTRALIZATION

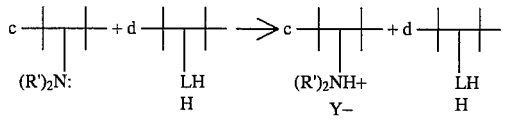

EQUATION 2
AMINE ALKYLATION AT ANY ACID BASE REPEAT UNIT RATIO WITHOUT ACID NEUTRALIZATION

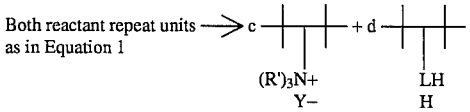

In Equations 3 to 11, various Levels of Acid Neutralization from Various Repeat Unit Ratios of Reactants wherein the Two Reactants Always Equal the Two Products from Equation 2.

EQUATION 3
NEUTRALIZATION OF 100% OF THE ACID REPEAT UNITS ACID PRESENT IN EXCESS VS. THE ALKYLATED AMMONIUM REPEAT UNITS
(D > C; D = 4 AND C = 2)

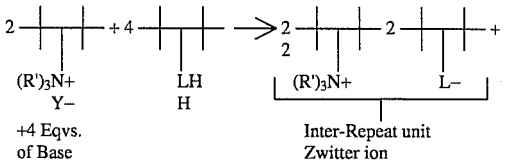

-continued

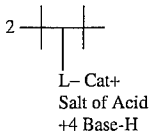

EQUATION 4
NEUTRALIZATION OF 75% OF THE ACID REPEAT UNITS ACID PRESENT IN EXCESS VS. THE ALKYLATED AMMONIUM REPEAT UNITS
(D > C; D = 4 AND C = 2)

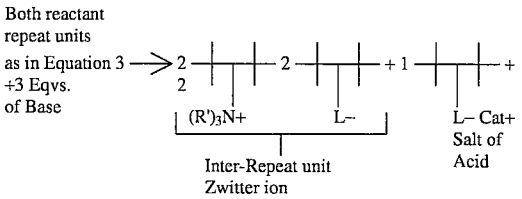

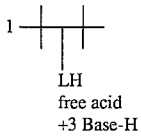

EQUATION 5
NEUTRALIZATION OF 50% OF THE ACID REPEAT UNITS ACID PRESENT IN EXCESS VS. THE ALKYLATED AMMONIUM REPEAT UNITS
(D >C; D = AND C = 2)

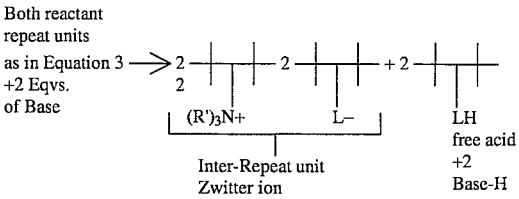

EQUATION 6
NEUTRALIZATION OF 25% OF THE ACID REPEAT UNITS ACID PRESENT IN EXCESS VS. THE ALKYLATED AMMONIUM REPEAT UNITS
(D >C; D = 4 AND C = 2)

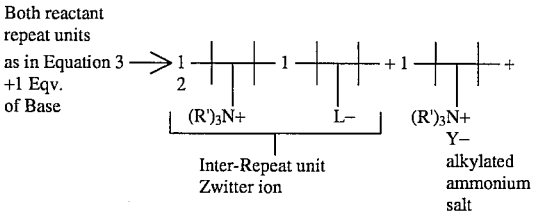

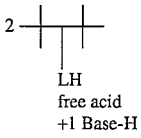

EQUATION 7
NEUTRALIZATION OF 100% OF THE ACID REPEAT UNITS ALKYLATED AMMONIUM UNITS PRESENT IN EXCESS VS. ACID
(C >D; C = 4 AND D = 2)

-continued

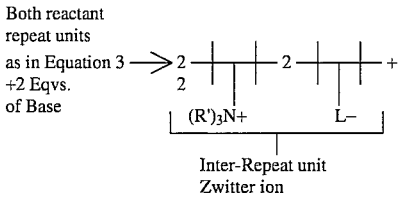

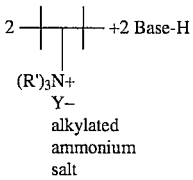

EQUATION 8
NEUTRALIZATION OF 50% OF THE ACID REPEAT UNITS ALKYLATED AMMONIUM REPEAT UNITS PRESENT IN EXCESS VS. ACID
(C >D; C = 4 AND D = 2)

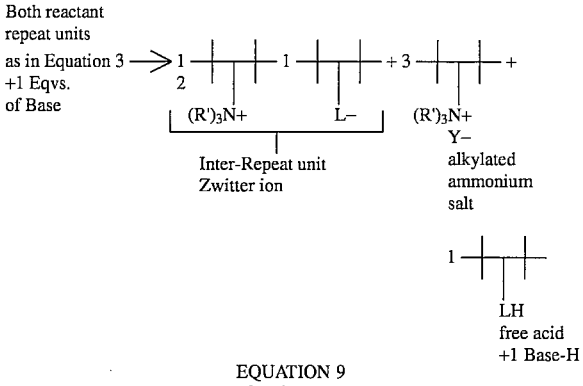

EQUATION 9
NEUTRALIZATION OF 100% OF THE ACID REPEAT UNITS ALKYLATED AMMONIUM REPEAT UNITS EQUAL ACID REPEAT UNITS
(C = D = 4)

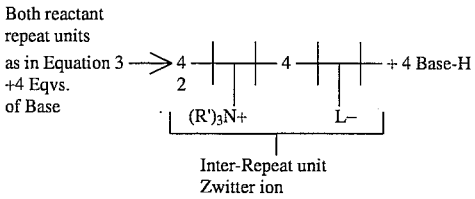

EQUATION 10
NEUTRALIZATION OF 75% OF THE ACID REPEAT UNITS ALKYLATED AMMONIUM REPEAT UNITS EQUAL ACID REPEAT UNITS
(C = D = 4)

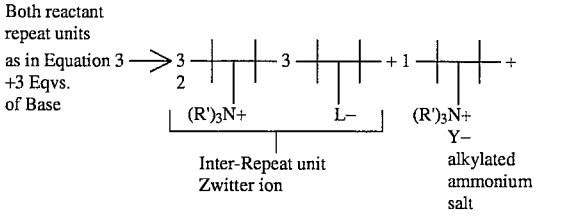

-continued

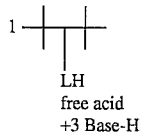

EQUATION 11
NEUTRALIZATION OF 25% OF THE ACID
REPEAT UNITS ALKYLATED AMMONIUM REPEAT UNITS
EQUAL ACID REPEAT UNITS
(C = D = 4)

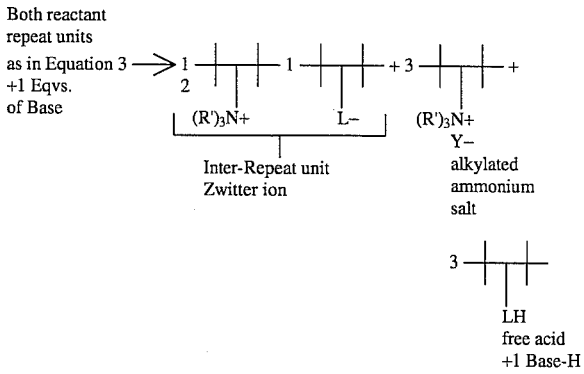

Examples of BAA', BA'A or ABA' triblock copolymer or B(AA') diblock copolymer charge directors are provided in the arbitrary block sequence of ABA'. The arbitrarily chosen block naming sequence does not designate any specific preferred block order or number. Examples include an excess of acid containing repeat units in the A' block or an excess of salt containing repeat units also in the A' block, or an excess of protonated ammonium salt or alkylated ammonium quaternized repeat units in the A block. In all examples, the nonpolar B block component, 2-ethylhexyl methacrylate, can be partly or totally substituted for with 2-ethylhexyl acrylate, and the polar A block component can be partly or totally substituted for with 2-dimethylaminoethyl acrylate and its corresponding protonated and alkylated ammonium species. The inter-repeat unit Zwitter ion components are designated as cation ZI or anion-ZI and represent alkylated ammonium repeat units in the polar A block and conjugated acid anion repeat units in the polar A' block, respectively. Examples include (1) poly[N,N-dimethylammoniumethyl-2-aminoethyl methacrylate bromide (A block) co-2-ethylhexyl methacrylate (B block)-co-methacrylic acid (A' block)]; charge director containing protonated ammonium A block repeat units and unneutralized acid A' block repeat units in any desired repeat unit ratios without inter-repeat unit Zwitter ion as in Equation 1; (2) poly[N,N,N-trimethylammoniumethyl methacrylate bromide (A block)-co-2-ethylhexyl methacrylate (B block)-co-methacrylic acid (A' block)]; charge director containing alkylated ammonium A block repeat units and unneutralized acid A' block repeat units in any desired repeat unit ratios without inter-repeat unit Zwitter ion as in Equation 2; (3) poly[N,N,N-trimethylammoniumethyl methacrylate (A block-ZI cation)-co-2-ethylhexyl methacrylate (B block)-co-methacrylate (A' block-ZI anion)-co-sodium methacrylate (A' block-neutral salt)]; charge director with alkylated ammonium A block repeat units as ZI cation source and totally neutralized acid A' block repeat units as ZI anion and neutral salt sources wherein the original acid repeat units are in excess versus the alkylated ammonium repeat units as in Equation 3; contains inter-repeat unit Zwitter ion to the extent that a repeat unit balance exists between the alkylated ammonium repeat units and the neutralized acid repeat units; (4) poly[N,N,N-trimethylammoniumethyl methacrylate (A block-ZI cation)-co-2-ethylhexyl methacrylate (B block)-co-methacrylate (A' block-ZI anion)-co-sodium methacrylate (A' block-neutral salt)-co-methacrylic acid (A' block-free acid)]; charge director with alkylated ammonium A block repeat units as ZI cation source and mostly neutralized acid A' block repeat units as ZI anion and neutral salt sources (neutralized to an extent greater than the original molar quantity of alkylated ammonium quat present) wherein the original acid repeat units are in excess versus the alkylated ammonium repeat units as in Equation 4; contains inter-repeat unit Zwitter ions to the extent that a repeat unit balance exists between the alkylated ammonium repeat units and the neutralized acid repeat units; (5) poly[N,N,N-trimethylammoniumethyl methacrylate bromide (A block-alkyl ammonium quat)-co-N,N,N-trimethylammoniumethyl methacrylate (A block-ZI cation)-co- 2-ethylhexyl methacrylate (B block)-co-methacrylate (A' block-ZI anion)-co-methacrylic acid (A' block-free acid)]; charge director with alkylated ammonium A block repeat units as ZI cation and alkyl ammonium quat sources and slightly neutralized acid A' block repeat units as ZI anion source (neutralized to an extent less than the original molar quantity of alkylated ammonium quat present) wherein the original acid repeat units are in excess versus the alkylated ammonium repeat units as in Equation 6, which contains inter-repeat unit Zwitter ions to the extent that a repeat unit balance exists between the alkylated ammonium repeat units and the neutralized acid repeat units; and (6) poly[N,N,N-trimethyl-2-ammoniumethyl (A block-ZI cation)/methacrylate (A' block-ZI anion)-co-2-ethylhexyl methacrylate (B block)]; charge director with balanced inter-repeat unit Zwitter ion only; wherein the original free acid repeat units (as ZI anion source) and the alkylated ammonium repeat units (as ZI cation source) are present in equal amounts and sufficient base is added to neutralize all the originally present free acid as in Equation 9.

One preferred acid containing BAA', BA'A, ABA', and B(AA') ammonium block copolymer charge director of the present invention contains (1) polar A block(s) which contain the positive ammonium nitrogen, (2) nonpolar B block(s) which has sufficient aliphatic content to enable the block copolymer to more effectively dissolve in the nonpolar liquid with, for example, a Kauri-butanol value of less than about 30, and in embodiments from about 5 to about 30, and (3) polar A' block(s) which contains the acid functionality or the conjugate acid anion of an acid functionality or the neutralized salt of an acid functionality. The total number of blocks in the multiple block copolymer charge directors is at least two. The A block and the A' block usually possess a number average molecular weight of from about 200 to about 120,000, and the B block possesses a number average molecular weight range of from about 2,000 to about 190,000 with a $M_w$ to $M_n$ ratio of 1 to 5.

The A block precursor polyamine is usually prepared from an amine containing monomer which after polymerization is protonated by treatment with the appropriate acid or is alkylated by treatment with the appropriate alkylating agent to form the ammonium A block. Examples of selected A block precursors include polymers prepared from different monomers of 1) $CH_2{=}CRCO_2R^1$ wherein R is hydrogen, or alkyl, aryl, or alkylaryl of 1 to about 20 carbons with or without heteroatoms wherein heteroatoms include oxygen, sulfur, phosphorous, nitrogen, fluorine, chlorine, bromine, iodine, silicon, and the like; and $R^1$ is alkyl of 1 to about 20 carbons where the terminal end of $R^1$ is of the general formula $—N(R^2)_2$, where N is nitrogen, $R^2$ is alkyl or cycloalkyl of 1 to about 30 carbons, aryl or alkylaryl of 6 to about 24 carbons; or 2) 2, 3, or 4-vinylpyridine wherein the ring carbon atoms not substituted with the vinyl group are substituted with $R^2$. Examples of specific monomers selected as A block repeat units after polymerization but prior to nitrogen protonation or quaternization include N,N-dimethylamino-N-2-ethyl methacrylate, N,N-diethylamino-N-2-ethyl methacrylate, N,N-dimethylamino-N-2-ethyl acrylate, N,N-diethylamino-N-2-ethyl acrylate, N,N-morpholino-N-2-ethyl methacrylate, N,N-morpholino-N-2-ethyl acrylate, 4-vinyl-pyridine, 2-vinyl-pyridine, 3-vinyl pyridine, and the like. B blocks include polymers prepared from one to five different monomers, such as those represented by the general formulas, $CH_2{=}CHR^3$ wherein $R^3$ is as follows, excluding hydrogen, $CH_2{=}CR^3CO_2R^4$ wherein $R^3$ is hydrogen saturated or unsaturated, linear or branched alkyl of 1 to 30 carbons, or alkylaryl or cycloalkylaryl of 10 to about 30 carbons with or without heteroatoms, and $CH_2{=}CHCO_2R^4$ wherein $R^4$ is saturated or unsaturated, linear or branched, alkyl or cycloalkyl of 4 to about 30 carbons; or saturated or unsaturated, linear or branched, alkylaryl or cycloalkylaryl of 10 to 30 carbons with or without heteroatoms. Examples of specific monomers selected for conversion to A' block repeat units after polymerization include (1) $CH_2{=}CR^7{-}(R^8){-}CO_2H$, (2) $CH_2{=}CR^7{-}(R^8){-}SO_3H$, (3) $CH_2{=}CR^7{-}(R^8){-}PO_3H$, (4) $CH_2{=}CR^7{-}(R^8){-}AsO_3H$, (5) $CH_2{=}CR^7{-}(R^8){-}SeO_3H$, (6) $CH_2{=}CR^7{-}(R^8){-}SO_2H$, (7) $CH_2{=}CR^7{-}(R^8){-}PHO_2H$, and (8) $CH_2{=}CR^7{-}(R^8){-}SiO_3H_2$ wherein $R^7$ is hydrogen, alkyl, aryl, or alkylaryl of 1 to about 20 carbons with or without heteroatoms wherein heteroatoms include oxygen, sulfur, phosphorous, selenium, arsenic, nitrogen, fluorine, chlorine, bromine, iodine, silicon, and wherein the heteroatoms may be part of a second Bronsted acid group having a pKa of <7 to>about −4, and $R^8$ is a covalent bond or a covalent bond to an oxygen heteroatom or a covalent bond to a cluster of atoms such as linear or branched alkylene or cycloalkylene of 1 to about 30 carbons, substituted or unsubstituted arylene, alkylarylene or cycloalkylarylene of 6 to about 24 carbons with or without heteroatoms wherein the terminal atom of the cluster may be oxygen or any atoms included in the $R^8$ cluster. Polar A' blocks include repeat unit sequences prepared from monomers containing a vinyl group and at least one acidic functionality or neutralized salt of said acid functionality, which free acid monomers include methacrylic acid, acrylic acid, 4-vinylbenzoic acid, 4-vinyl-1-naphthoic acid, 5-vinyl-2-carboxythiophene, 5-vinyl-2-carboxyfuran, vinylphosphonic acid, 4-vinylbenzenephosphonic acid, vinylphosphinic acid, 4-vinylbenzenesulfinic acid, vinylphosphoric acid, vinylsulfonic acid, 4-vinylbenzenesulfonic acid, vinylsulfinic acid, 4-vinylbenzenearsonic acid, 4-vinylbenzenearsonous acid, 4-vinylphenylselenous acid, 4-vinylphenylselenic acid, 4-vinylphenylsilic acid, 4-vinylphenyl-N-methyl sulfamic acid, 4-vinylphenylsulfurous acid, 4-vinlphenylhydrogen sulfate, 4-vinylphenylhydrogen carbonate, 4-vinylphenylhydrogen sulfite, itaconic acid and the like.

Examples of monomers selected for preparing B blocks in the range of 0.1 to 100 percent include 2-ethylhexyl methacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, methoxybutadiene, isobutylene, cyclohexylethylene, cyclohexenylethylene, myrcene, piperylene, 1-dodecene, 4-tert butylstyrene, 3-tert butylstyrene, cyclooctene, cyclopentene, norbornene, and the like. Optional nonpolar B blocks can be comprised of polymers prepared from at least one monomer selected from the group consisting of $CH_2{=}CHCON(R^4)_2$ and $CH_2{=}CR^3CON(R^4)_2$ where $R^3$ and $R^4$ are as illustrated herein.

Examples of acids in the range of 0.1 to 100 percent that may be selected to convert the amine containing A block precursor to the protonated ammonium A block include acids with a pKa of less than or equal to about 4.5, preferably less than 3.0, and from, for example, 1 to about 3. Acids include hydrobromic acid, hydrochloric acid, hydrofluoric acid, hydroiodic acid, phosphoric acid, sulfuric acid, tetrafluoroboric acid, dichloroacetic acid, difluoroacetic acid, trichloroacetic acid, trifluoroacetic acid, tetrafluoroterephthalic acid, tetrafluorosuccinic acid, hexafluoroglutaric acid, hexafluorophosphoric acid, 3-methylsalicylic acid, 5-chlorosalicylic acid, butanesulfonic acid, dodecanesulfonic acid, methanesulfonic acid, trifluoromethanesulfonic acid, p-toluenesulfonic acid, benzenesulfonic acid, dodecylbenzenesulfonic acid and naphthalene-1,5-disulfonic acid.

Alkylating agents in the amount range of 0.1 to 100 percent that may be selected to convert the amine containing A block precursor to the alkylated ammonium A block include methyl bromide, methyl p-toluenesulfonate, methyl trifluoromethanesulfonate, ethyl p-toluenesulfonate, methyl chloride, methyl iodide, butyl bromide, dodecyl chloride, dodecyl iodide, allyl bromide, benzyl bromide, methyl sulfate, methyl hydrogen sulfate, triethyloxonium tetrafluoroborate, trimethyloxonium tetrafluoroborate, trimethyl phosphate and the like.

Inorganic or organic bases having sufficient base strength to neutralize at least one of the acidic hydrogens in the A' block repeat units are used to generate the anion fragment or conjugate acid of the inter-repeat unit Zwitter ion and the neutralized salt of the original acid group. Suitable inorganic bases generally include metal hydrides, methoxides, hydroxides, carbonates, and the like. Suitable hydrides include lithium hydride, sodium hydride, calcium hydride, barium hydride, and zirconium hydride. Suitable methoxides include sodium methoxide, potassium tert. butoxide, aluminum isopropoxide, iron (III) methoxide, and manganese (II) methoxide. Suitable hydroxides include lithium hydroxide, sodium hydroxide, and potassium hydroxide. Suitable carbonates include sodium carbonate and sodium hydrogen carbonate. Suitable strong organic bases include (1) trialkyl amines such as triethylamine, triisopropylamine, tributylamine, 1,4-diazabicyclo[2.2.2]octane, quinuclidine, and 1,8-bis-(dimethylamino)-naphthalene; (2) cyclic amidines such as 1,5-diazabicyclo[4.3.0]non-5-ene and 1,8-diazabicyclo[5.4.0]undec-7-ene; (3) and organic ammonium hydroxides such as tetrabutylammonium hydroxide and benzyltrimethylammonium hydroxide.

In embodiments, the acid or acid derivative and ammonium containing BAA', BA'A or ABA' triblock copolymer and B(AA') diblock copolymer can be prepared by the polymerization of amine A block monomers (which after polymerization are alkylated or protonated to become ammonium A block repeat units) with polar A' block acid containing monomers (which after polymerization can either remain as the free acid or can be neutralized to give the conjugate acid anion component of the inter-repeat unit Zwitter ion or the salt of the acid), and with nonpolar B block monomers in whatever sequence that will generate the desired block copolymer configuration. A subsequent neutralization step of the acid functionality in the polar A' block is selected to synthesize the inter-repeat unit Zwitter ion content into the charge director copolymer unless the salt of the acid was polymerized, in which case Zwitter ion formation would occur as soon as the alkylated ammonium repeat units in the polar A block were introduced into the copolymer. The alkylated ammonium repeat units can either be introduced in a polymer modification reaction by alkylation of the corresponding amine repeat units or by polymerization of the alkylated ammonium monomer directly. However, inter-repeat unit Zwitter ions need not be present in the charge director copolymer (as in Equations 1 to 2) but could be present (as in Equations 3 to 11) to obtain improved charging levels. The presence of inter-repeat unit Zwitter ions enables improved toner charging levels. Improved charging levels can also be obtained by incorporating only unneutralized acid groups (in repeat unit contents > or < or equal to the ammonium repeat unit content) into the polar A' block of the charge director copolymer. Since no base neutralization step is then effected, no inter-repeat unit Zwitter ions can be co-present in the charge director copolymer (Equations 1 to 2). Improved charging levels can also be obtained by incorporating the neutralized salt of the acid into the polar A' block of the charge director copolymer, and in which situation (Equations 3 to 4) some inter-repeat unit Zwitter ions are present.

The block sequence names for the following unneutralized block copolymer charge directors containing unneutralized free acid and protonated ammonium repeat units do not designate any preferred block order. The protonated ammonium 2-dimethylaminoethyl methacrylate repeat units in the polar A block can be partly or totally substituted for by the corresponding protonated ammonium 2-dimethylaminoethyl acrylate repeat units as can the 2-ethylhexyl methacrylate repeat units in the nonpolar B block by 2-ethylhexyl acrylate repeat units. Examples of acid and ammonium containing BAA' or BA'A or ABA' triblock copolymers or B(AA') diblock copolymers selected in the range of 0.1 to 100 percent (nonpolar B block named first then polar A block, then polar A' block) include poly[2-ethylhexyl methacrylate (B block)-co-N,N-dimethylammoniumethyl methacrylate bromide (A block)oco-methacrylic acid (A' block)], poly[2-ethylhexyl methacrylate (B block)-co-N,N-dimethylammoniumethyl methacrylate tosylate (A block)-co-methacrylic acid (A' block)], poly[2-ethylhexyl methacrylate (B block)-co-N,N-dimethylammoniumethyl methacrylate bromide (A block)-co-itaconic acid (A' block)], poly[2-ethylhexyl methacrylate (B block)-co-N,N-dimethylammoniumethyl methacrylate bromide (A block)-co-acrylic acid (A' block)], poly[2-ethylhexyl methacrylate (B block)-co-N,N-dimethylammoniumethyl methacrylate tosylate (A block)-co-acrylic acid (A' block)], poly[2-ethylhexyl methacrylate (B block)-co-N,N-dimethylammoniumethyl methacrylate chloride (A block)-co-methacrylic acid (A' block)], poly[2-ethylhexyl methacrylate (B block)-co-N,N-dimethylammoniumethyl methacrylate chloride (A block)-co-acrylic acid (A' block)], poly[2-ethylhexyl acrylate (B block)-co-N,N-dimethylammoniumethyl methacrylate bromide (A block)-co-methacrylic acid (A' block)], poly[2-ethylhexyl acrylate (B block)-co-N,N-dimethylammoniumethyl acrylate bromide (A block)-co-methacrylic acid (A' block)], poly[2-ethylhexyl acrylate (B block)-co-N,N-dimethylammoniumethyl methacrylate tosylate (A block)-co-methacrylic acid (A' block)], poly[2-ethylhexyl acrylate (B block)-co-N,N-dimethylammoniumethyl acrylate tosylate (A block)-co-methacrylic acid (A' block)], poly[2-ethylhexyl acrylate (B block)-co-N,N-dimethylammoniumethyl methacrylate chloride (A block)-co-methacrylic acid (A' block)], poly[2-ethylhexyl acrylate (B block)-co-N,N-dimethylammoniumethyl acrylate chloride (A block)-co-methacrylic acid (A' block)], poly[N,N-dibutyl methacrylamide (B block)-co-N,N-dimethylammoniumethyl methacrylate bromide (A block)-co-methacrylic acid (A' block)], poly[N,N-dibutyl methacrylamide (B block)-co-N,N-dimethylammoniumethyl methacrylate bromide (A block)-co-acrylic acid (A' block)], poly[N,N-dibutylmethacrylamide (B block)-co-N,N-dimethylammoniumethyl methacrylate tosylate (A block)-co-methacrylic acid (A' block)], poly[N,N-dibutyl methacrylamide (B block)-co-N,N-dimethylammoniumethyl methacrylate tosylate (A block)-co-acrylic acid (A' block)], poly[N,N-dibutylacrylamide (B block)-co-N,N-dimethylammoniumethyl methacrylate bromide (A block)-co-methacrylic acid (A' block)], poly[N,N-dibutylacrylamide (B block)-co-N,N-dimethylammoniumethyl methacrylate tosylate (A block)-co-methacrylic acid (A' block)], poly[2-ethylhexyl methacrylate (B block)-co-4-vinyl-N,N-dimethylanilinium bromide (A block)-co-methacrylic acid (A' block)], poly[2-ethylhexyl methacrylate (B block)-co-4-vinyl-N,N-dimethylanilinium bromide (A block)-co-acrylic acid (A' block)], poly[2-ethylhexyl methacrylate (B block)-co-4-vinyl-N,N-dimethylanilinium tosylate (A block)-co-methacrylic acid (A' block)], poly[2-ethylhexyl methacrylate (B block)-co-4 -vinyl-N,N-dimethylanilinium tosylate (A block)-co-acrylic acid (A' block)], poly[2-ethylhexyl methacrylate (B block)-co-N,N-dimethylammoniumethylene bromide (A block)-co-methacrylic acid (A' block)], poly[2-ethylhexyl methacrylate (B block)-co-N,N-dimethylammoniumethylene bromide (A block)-co-acrylic acid (A' block)], and poly[2-ethylhexyl methacrylate (B block)-co-N,N-dimethylammoniumpropylene bromide (A block)-co-methacrylic acid (A' block)].

Also, examples of nonpolar liquid soluble acid and alkylated or protonated ammonium containing BAA', BA'A, ABA' or B(AA') block copolymer charge directors selected in the range of 0.1 to 100 percent (nonpolar B block named first then polar A block and then polar A' block) include poly[2-ethylhexyl methacrylate (B block)-co-N,N,N-trimethylammoniumethyl methacrylate bromide (A block)-co-methacrylic acid (A' block)], poly[2-ethylhexyl methacrylate (B block)-co-N,N-dimethyl-N-butylammoniumethyl methacrylate bromide (A block)-co-acrylic acid (A' block)], poly[lauryl methacrylate (B block)-co-N,N,N-trimethylammoniumethyl methacrylate bromide (A block)-co-methacrylic acid (A' block)], poly[lauryl methacrylate (B block)-co-N,N-dimethylammoniumethyl bromide methacrylate bromide (A block)-co-methacrylic acid (A' block)], poly[2-ethylhexyl methacrylate (B block)-co-N,N-dimethyl-N-butylammoniumethyl methacrylate tosylate (A block)-co-acrylic acid (A' block)], poly[2-ethylhexyl methacrylate (B block)-co-N,N,N-trimethylammoniumethyl methacrylate tosylate (A block)-co-methacrylic acid (A' block)], poly[2-ethylhexyl methacrylate (B block)-co-N,N,N-trimethylammoniumethyl methacrylate chloride (A block)-co-methacrylic acid (A' block)], poly[2-ethylhexyl methacrylate (B block)-co-N,N-dimethylammoniumethyl methacrylate chloride (A block)-co-methacrylic acid (A' block)], poly[2-ethylhexyl methacrylate (B block)-co-N,N,N-trimethylammoniumethyl methacrylate phosphate (A block)-co-methacrylic acid (A' block)], poly[2-ethylhexyl methacrylate (B block)-co-N,N,N-trimethylammoniumethyl methacrylate sulfate (A block)-co-methacrylic acid (A' block)], and poly[2-ethylhexyl methacrylate (B block)-co-N,N-dimethylammoniumethyl methacrylate sulfate (A block)-co-methacrylic acid (A' block)].

The names in the following list are in the form of balanced Zwitter ion containing block copolymers only (as in Equation 9) primarily for brevity purposes. These block copolymer charge directors can also contain alkylated ammonium quaternized repeat units, neutralized acid salt repeat units, unneutralized acid repeat units or mixtures thereof except for mixtures of alkylated ammonium salt and neutralized acid salt repeat units which immediately form the inter-repeat unit Zwitter ion to the extent that their stoichiometry is balanced. The protonated ammonium 2-dimethylaminoethyl methacrylate repeat units in the polar A block can be partly or totally substituted for by the corresponding protonated ammonium 2-dimethylaminoethyl acrylate repeat units as can the 2-ethylhexyl methacrylate repeat units in the nonpolar B block by 2-ethylhexyl acrylate repeat units. Examples of additional BAA', BA'A or ABA' triblock copolymer and B(AA') diblock copolymer charge directors containing acid and alkylated ammonium quaternized repeat units prior to neutralization and which after neutralization are converted to inter-repeat unit Zwitter ions (nonpolar B block named first then polar A block, and then polar A' block) in the range of 0.1 to 100 percent include poly[2-ethylhexyl methacrylate (B block)-co-N,N,N-trimethylammoniumethyl methacrylate (A block-ZI cation)/methacrylate (A' block-ZI anion)], poly[2-ethylhexyl methacrylate (B block)-co-N,N,N-trimethyl-ammoniumethyl methacrylate (A block-ZI cation)/4-vinylbenzoate (A' block-ZI anion)], poly[2-ethylhexyl methacrylate (B block)-co-N,N,N-trimethylammoniumethyl methacrylate (A block-ZI cation)/4-vinylbenzenesulfonate (A' block-ZI anion)], poly[2-ethylhexyl methacrylate (B block)-co-N,N,N-trimethylammoniumethyl methacrylate (A block-ZI cation)/4-vinylbenzenesulfinate (A' block-ZI anion)], poly[2-ethylhexyl methacrylate (B block)-co-N,N,N-trimethylammoniumethyl methacrylate (A block-ZI cation)/4-vinylbenzenephosphonate (A' block-ZI anion)], poly[2-ethylhexyl methacrylate (B block)-co-N,N,N-trimethyl-ammoniumethyl methacrylate (A block-ZI cation)/4-vinylbenzenearsonate (A' block-ZI anion)], poly[2-ethylhexyl methacrylate (B block)-co-N,N,N-trimethylammoniumethyl methacrylate (A block-ZI cation)/4-vinylbenzeneselenate (A' block-ZI anion)], poly[2-ethylhexyl methacrylate (B block)-co-N,N,N-trimethylammoniumethyl methacrylate (A block-ZI cation)/itaconate (A' block-ZI anion)], poly[N,N-dibutylmethacrylamide (B block)-co-N,N,N-trimethylammoniumethyl methacrylate (A block-ZI cation)/methacrylate (A' block-ZI anion)], poly[N,N-dibutylmethacrylamide (B block)-co-N,N,N-trimethylammoniumethyl methacrylate (A block-ZI cation)/acrylate (A' block-ZI anion)], poly[N,N-dibutylmethacrylamide (B block)-co-N,N,N-trimethylammoniumethyl methacrylate (A block-ZI cation)/4-vinylbenzene carboxylate (A' block-ZI anion)], poly[N,N-dibutylmethacrylamide (B block)-co-N,N,N-trimethylammoniumethyl methacrylate (A block-ZI cation)/itaconate (A' block-ZI anion)], poly[N,N-dibutylmethacrylamide (B block)-co-N,N,N-trimethylammoniumethyl methacrylate (A block-ZI cation)/4-vinylbenzenesulfonate (A' block-ZI anion)], poly[N,N-dibutylmethacrylamide (B block)-co-N,N,N-trimethylammoniumethyl methacrylate (A block-ZI cation)/4-vinylbenzenesulfinate (A' block-ZI anion)], poly[N,N-dibutylmethacrylamide (B block)-co-N,N,N-trimethylammoniumethyl methacrylate (A block-ZI cation)/4-vinylbenzenephosphonate (A' block-ZI anion)], poly[N,N-dibutylmethacrylamide (B block)-co-N,N,N-trimethylammoniumethyl methacrylate (A block-ZI cation)/4-vinylbenzenephosphinate (A' block-ZI anion)], poly[N,N-dibutylmethacrylamide (B block)-co-N,N,N-trimethylammoniumethyl methacrylate (A block-ZI cation)/4-vinylbenzenearsonate (A' block-ZI anion)], and poly[N,N-dibutylmethacrylamide (B block)-co-N,N,N-trimethyl-ammoniumethyl methacrylate (A block-ZI cation)/4-vinylbenzeneselenate (A' block-ZI anion)].

Vinylpyridine monomers, which are copolymerized and then alkylated or optionally alkylated and then copolymerized to provide the alkylated pyridinium block, may be 2 or 3 vinyl pyridinium isomer repeat units in addition to the exemplified 4-vinylpyridinium isomer repeat units. Also, 2-ethylhexyl acrylate may be substituted for 2-ethylhexyl methacrylate.

The names in the following list are in the form of balanced Zwitter ion containing block copolymers only (as in Equation 9) for brevity purposes. These block copolymer charge directors can also contain alkylated pyridinium quaternized repeat units, neutralized acid salt repeat units, unneutralized acid repeat units or mixtures thereof except for mixtures of alkylated pyridinium salt and neutralized acid salt repeat units which immediately form the inter-repeat unit Zwitter ion to the extent that their stoichiometry is balanced. Additional suitable examples of nonpolar liquid soluble BAA', BA'A or ABA' triblock copolymer and B(AA') diblock copolymer charge directors containing acid and alkylated pyridinium quaternized repeat units prior to neutralization which after neutralization are converted to inter-repeat unit Zwitter ions (polar A block named first then polar A' block and then nonpolar B block) in the range of 0.1 to 100 percent include poly[4-vinyl-N-methylpyridinium (A block-ZI cation)-co-methacrylate (A' block-ZI anion)-co-2-ethylhexyl methacrylate (B block)], poly[4-vinyl-N-methylpyridinium (A block-ZI cation)-co-acrylate (A' block-ZI anion)-co-2-ethylhexyl methacrylate (B block)], poly[4-vinyl-N-methylpyridinium (A block-ZI cation)-co-4-vinylbenzoate (A' block-ZI anion)-co-2-ethylhexyl methacrylate (B block)], poly[4-vinyl-N-methylpyridinium (A block-ZI cation)-co-itaconate (A' block-ZI anion)-co-2-ethylhexyl methacrylate (B block)], poly[4-vinyl-N-methylpyridinium (A block-ZI cation)-co-4-vinylbenzenesulfonate (A' block-ZI anion)-co-2-ethylhexyl methacrylate (B block)], poly[4-vinyl-N-methylpyridinium (A block-ZI cation)-co-4-vinylbenzenesulfinate (A' block-ZI anion)-co-2-ethylhexyl methacrylate (B block)], poly[4-vinyl-N-methylpyridinium (A block-ZI cation)-co-4-vinylbenzenephosphonate (A' block-ZI anion)-co-2-ethylhexyl methacrylate (B block)], poly[4-vinyl-N-methylpyridinium (A block-ZI cation)-co-4-vinylbenzenephosphinate (A' block-ZI anion)-co-2-ethylhexyl methacrylate (B block)], poly[4-vinyl-N-methylpyridinium (A block-ZI cation)-co-4-vinylbenzenearsonate (A' block-ZI anion)-co-2-ethylhexyl methacrylate (B block)], poly[4-vinyl-N-methylpyridinium (A block-ZI cation)-co-4-vinylbenzeneselenate (A' block-ZI anion)-co-2-ethylhexyl methacrylate (B block)], poly[4-vinyl-N-methylpyridinium (A block-ZI cation)-co-methacrylate (A' block-ZI anion)-co-p-tertiary butylstyrene (B block)], and the like. In the aforementioned pyridinium examples, additional examples of nonpolar liquid soluble inter-repeat unit zwitterionic BAA', BA'A or ABA' triblock copolymer and B(AA') diblock copolymer charge directors include poly[4-vinyl-N-butylpyridinium (A block-ZI cation)-co-methacrylate (A' block-ZI anion)-co-2-ethylhexyl methacrylate (B block)], poly[4-vinyl-N-benzylpyridinium (A block-ZI cation)-co-acrylate (A' block-ZI anion)-co-2-ethylhexyl methacrylate (B block)], poly[4-vinyl-N-benzylpyridinium (A block-ZI cation)-co-4-vinylbenzenephosphonate (A' block-ZI anion)-co-2-ethylhexyl methacrylate (B block)], poly[4-vinyl-N-benzylpyridinium (A block-ZI cation)-co-4-vinylbenzenephosphinate (A' block-ZI anion)- co-2-ethylhexyl methacrylate (B block)], poly[4-vinyl-N-ethyleneoxyethylpyridinium (A block-ZI cation)-co-methacrylate (A' block-ZI anion)-co-2-ethylhexyl methacrylate (B block)], poly[4-vinyl-N-ethyleneoxyethylpyridinium (A block-ZI cation)-co-4-vinylbenzenesulfonate (A' block-ZI anion)-co-2-ethylhexyl methacrylate (B block)], poly[4-vinyl-N-ethylpyridinium (A block-ZI cation)-co-methacrylate (A' block-ZI anion)-co-p-tertiary butylstyrene (B block)] poly[4-vinyl-N-propylpyridinium (A block-ZI cation)-co-4-vinylbenzenesulfonate (A' block-ZI anion)-co-2-ethylhexyl methacrylate (B block)], poly[4-vinyl-N-ethylpyridinium (A block-ZI cation)-co-4-vinylbenzenearsonate (A' block-ZI anion)-co-2-ethylhexyl methacrylate (B block)], poly[4-vinyl-N-ethyleneoxyethylpyridinium (A block-ZI cation)-co-4-vinylbenzenecarboxylate (A' block-ZI anion)-co-2-ethylhexyl methacrylate (B block)], poly[4-vinyl-N-isobutylpyridinium (A block-ZI cation)-co-itaconate (A' block-ZI anion)-co-2-ethylhexyl methacrylate (B block)], and the like.

In the following, the corresponding 2- and 3-vinylpyridinium isomers can be substituted for the 4-vinylpyridinium isomer repeat units in the polar A block as can any other strong acid (preferably of pKa less than or equal to 3.0) be substituted for hydrogen bromide in preparing the protonated pyridinium salt. Also, 2-ethylhexyl acrylate may be substituted for 2-ethylhexyl methacrylate. Additional examples of nonpolar liquid soluble acid and protonated pyridinium containing BAA', BA'A or ABA' triblock copolymer and B(AA') diblock copolymer charge directors selected in the range of 0.1 to 100 percent (polar A block named first then polar A' block and then nonpolar B block) include poly[4-vinyl-N-pyridinium bromide (A block)-co-methacrylic acid (A' block)-co-2-ethylhexyl methacrylate (B block)], poly[4-vinyl-N-pyridinium bromide (A block)-co-acrylic acid (A' block)-co-2-ethylhexyl methacrylate (B block)], poly[4-vinyl-N-pyridinium bromide (A block)-co-4-vinylbenzoic acid (A' block)-co-2-ethylhexyl methacrylate (B block)], poly[4-vinyl-N-pyridinium bromide (A block)-co-itaconic acid (A' block)-co-2-ethylhexyl methacrylate (B block)], poly[4-vinyl-N-pyridinium bromide (A block)-co-4-vinylbenzenesulfonic acid (A' block)-co-2-ethylhexyl methacrylate (B block)], poly[4-vinyl-N-pyridinium bromide (A block)-co-4-vinylbenzenesulfinic acid (A' block)-co-2-ethylhexyl methacrylate (B block)], poly[4-vinyl-N-pyridinium bromide (A block)-co-4-vinylbenzenephosphonic acid (A' block)-co-2-ethylhexyl methacrylate (B block)], poly[4-vinyl-N-pyridinium bromide (A block)-co-4-vinylbenzenephosphinic acid (A' block)-co-2-ethylhexyl methacrylate (B block)], poly[4-vinyl-N-pyridinium bromide (A block)-co-4-vinylbenzenearsonic acid (A' block)-co-2-ethylhexyl methacrylate (B block)], poly[4-vinyl-N-pyridinium bromide (A block)-co-4-vinylbenzeneselenic acid (A' block)-co-2-ethylhexyl methacrylate (B block)], poly[4-vinyl-N-pyridinium bromide (A block)-co-methacrylic acid (A' block)-co-p-tertiary butylstyrene (B block)], and the like.

One preferred ammonium BAA', BA'A, and ABA' triblock copolymer, or B(AA') diblock copolymer charge director of the present invention includes (1) polar A block(s) which contains the positive ammonium nitrogen, (2) nonpolar B block(s) which has sufficient aliphatic content, usually a minimum of four carbons with a maximum of about 100 carbons, to enable the block copolymer to more effectively dissolve in the nonpolar liquid having a Kauributanol value of less than about 30, and in embodiments from about 5 to about 30, and (3) polar A' block(s) which contains the acid functionality or the conjugate acid anion of an acid functionality or the neutralized salt of an acid functionality. The total number of blocks in, as indicated herein, these multiple block copolymer charge directors is at least two. The A block(s) and A' block(s) can have a number average molecular weight range of from about 200 to about 120,000 and the B block(s) can have a number average molecular weight range of from about 2,000 to about 190,000. Based on the above range of number average degree of polymerization (DP) for the polar A and A' block(s), the mole percent of all the polar A and A' block repeat units in the invention charge director multiple block copolymers can range from 0.4 to 83.3 percent. Based on the above range of number average degree of polymerization (DP) for the nonpolar B block(s), the mole percent of all the nonpolar B block repeat units in the charge director multiple block copolymers of this invention can satisfactorily range from 16.7 to 99.6 percent. The preferred repeat unit content of the polar A block(s) and polar A' block(s) is 60 to 0.4 mole percent and is more preferably at 25 to 0.4 mole percent, and the preferred repeat unit content of the nonpolar B block(s) is 40 to 99.6 mole percent and is more preferably at 75 to 99.6 mole percent. Amine nitrogen protonation or alkylation to form the ammonium polar A block repeat unit can be at least 80 mole percent and preferably at least 90 mole percent for satisfactory charge director performance. Acid neutralization with base to form the conjugate acid anion or salt of the polar A' repeat units in the BAA', BA'A or ABA' triblock copolymers or in the B(AA') diblock copolymer can be 0.1 to 100 mole percent when forming the desired quantity of inter-repeat unit Zwitter ions. The amount of unneutralized free acid or neutralized salt of the acid remaining in the charge director composition after forming the desired amount of inter-repeat unit Zwitter ions is in embodiment extensive because unneutralized free acid and neutralized salt of the acid also contribute to increasing developer charging versus developers charged with charge directors not containing acid groups in any of its three forms (free acid, conjugate acid anion as in an inter-repeat unit Zwitter ion, and neutralized salt of the acid).

The charge director can be selected for the liquid developers in various effective amounts, such as for example from about 0.5 percent to 100 percent by weight relative to developer solids and preferably 2 percent to 20 percent by weight relative to developer solids. Developer solids include toner resin, pigment, and optional charge adjuvant. Without pigment, the developer may be selected for the generation of a resist, or a printing plate, and the like.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeters, or more. Preferably, the liquid selected in embodiments is a branched chain aliphatic hydrocarbon. A nonpolar liquid of the ISOPAR® series available from Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters, and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E. I. DuPont de Nemours and Company, Wilmington, Del.); copolymers of ethylene, and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developers of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |

-continued

| PIGMENT BRAND NAME | MANUFACTURER | COLOR |
|---|---|---|
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps, like aluminum or magnesium stearate or octoate, fine particle size oxides, such as oxides of silica, alumina, titania, and the like, paratoluene sulfonic acid, and polyphosphoric acid, may be added. Negative charge adjuvants primarily increase the negative charge or decrease the positive charge of the toner particle, while the positive charge adjuvants increase the positive charge of the toner particles. With the invention of the present application, in embodiments the adjuvants or charge additives can be comprised of the metal catechol and aluminum hydroxy acid complexes illustrated in U.S. Pat. Nos. 5,306,591 and 5,308,731, the disclosures of which are totally incorporated herein by reference, and which additives in combination with the charge directors of the present invention have, for example, the following advantages: improved toner charging characteristics, namely, an increase in particle charge, as measured by ESA mobility, of from $-1.4$ E-10 $m^2/Vs$ to $-2.3$ E-10 $m^2/Vs$ that results in improved image development and transfer, from 80 percent to 93 percent, to allow improved solid area coverage, and a transferred image reflectance density of 1.2 to 1.3. The adjuvants can be added to the toner particles or toner solids in an amount of from about 0.1 percent to about 15 percent of the total developer solids and preferably from about 1 percent to about 5 percent of the total weigh t of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements accomplished by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding a charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. The charge director can be added at any point in the toner preparation, but is preferably added after the particles have been reduced to their desired size. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. The temperature at which this step is undertaken should not be so high as to degrade the nonpolar liquid or decompose the resin or colorant when present. Accordingly, the mixture is heated to a temperature of from about 70° C. to about 1.30° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids wherein solids include resin, charge adjuvant, and pigment concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image, or transfer to an intermediate belt, a second transfer to a substrate like paper, followed by fixing.

The present invention is illustrated in the following nonlimiting Examples, it being understood that these Examples are intended to be illustrative only and that the invention is not intended to be limited to the materials, conditions, process parameters, and the like recited herein. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science, Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba Instruments, Inc., Irvine, Calif.

EXAMPLE I

CYAN LIQUID TONER PREPARATION 1

One hundred seventy-nine and five tenths (179.5) grams of NUCREL 599®, a copolymer of ethylene and methacrylic acid with a melt index at 190° C. of 500 dg/minute, available from E. I. DuPont de Nemours & Company, Wilmington, Del., 45.4 grams of the cyan pigment PV FAST BLUE™, 2.3 grams of the charge adjuvant hydroxy bis[3,5-di-t-butyl salicylic]aluminate monohydrate prepared in Example IB, and 307.4 grams of ISOPAR M®, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° to 93° C. for 2 hours. An additional 980.1 grams of ISOPAR M® were added and the attritor contents were cooled to 12° C. by running cold water through the attritor jacket while cold grinding for an additional 4.5 hours. An additional 1,480 grams of ISOPAR M® were added and the mixture was separated by the use of a metal grate from the steel balls yielding a liquid toner concentrate of 7.37 percent solids wherein solids include resin, charge adjuvant and pigment, and 92.63 percent of ISOPAR M®. The particle diameter was 3.11 microns average by volume as measured with a Horiba Cappa 700. This cyan liquid toner concentrate was selected to prepare liquid toners or developers in Controls 1A, 1B, 2, and 3, and in Examples XIVA thru XIVD.

EXAMPLE IA

SYNTHESIS OF HYDROXY BIS[3,5-DI-T-BUTYL SALICYLIC]ALUMINATE MONOHYDRATE AT ELEVATED TEMPERATURE

To a solution of 12 grams (0.3 mole) of sodium hydroxide in 500 milliliters of water were added 50 grams (0.2 mole) di-t-butyl salicylic acid. The resulting mixture was heated to 60° C. to dissolve the acid. A second solution was prepared by dissolving 33.37 grams (0.05 mole) of aluminum sulfate, $Al_2(SO_4)_3 \cdot 18H_2O$, into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis[3,5-tert-butyl salicylic]aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis[3,5-di-t-butyl salicylic]aluminate monohydrate was analyzed for water of hydration by Karl-Fischer titration after drying for an additional 24 hours at 100° C. in a vacuum, the sample contained 2.1 percent weight of water. The theoretical value calculated for a monohydrate is 3.2 percent weight of water.

The infrared spectrum of the above product hydroxy bis[3,5-di-tertiary-butyl salicylic]aluminate monohydrate indicated the absence of peaks characteristic of the starting material di-t-butyl salicylic acid, and indicated the presence of an Al-OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared monohydrate.

Elemental Analysis Calculated for $C_{30}H_{41}O_7Al$: C, 66.25; H, 7.62; Al, 5.52. Calculated for $C_{30}H_{41}O_7Al \cdot 1H_2O$: C, 64.13; H, 7.74; Al, 4.81. Found: C, 64.26; H, 8.11; Al, 4.67.

EXAMPLE IB

SYNTHESIS OF HYDROXY BIS[3,5-DI-TERTIARY-BUTYL SALICYLIC]ALUMINATE HYDRATE AT ROOM TEMPERATURE

The procedure of the charge adjuvant synthesis in Example IA was repeated with the exception that the mixing of the two solutions and subsequent stirring was accomplished at room temperature, about 25° C. The product was isolated and dried as in Example IA, and identified as the above hydroxy aluminum complex hydrate by infrared spectroscopy.

EXAMPLE II

BASE POLYMER PREPARATION 1

Sequential group transfer polymerization (GTP) of 2-ethylhexyl methacrylate (EHMA), 2-dimethylaminoethyl methacrylate (DMAEMA), and trimethylsilyl methacrylate to prepare after hydrolysis the BAA' triblock copolymer precursor, poly[2-ethylhexyl methacrylate (B block)-co-N, N-dimethylamino-N-ethyl methacrylate (A block)-co-methacrylic acid (A' block)], of the hydrogen bromide ammonium salt BAA' triblock copolymer charge director was accomplished as follows.

The BAA' triblock copolymer precursor was prepared by a standard sequential group transfer polymerization procedure (GTP) wherein the 2-ethylhexyl methacrylate monomer was first polymerized to completion, and then the 2-dimethylaminoethyl methacrylate monomer was polymerized onto the living end of the ethylhexyl methacrylate polymer, and finally the trimethylsilyl methacrylate was polymerized onto the living end of the 2-dimethylaminoethyl methacrylate. All glassware was first baked out in an air convection oven at about 120° C. for about 16 to 18 hours.

A 250 milliliter 3-neck round bottom flask equipped with a magnetic stirring football, a thermometer, an Argon inlet and outlet, and a neutral alumina (50 grams) column (exchangeable with a rubber septum) was charged through the alumina column, which is maintained under a positive Argon flow and sealed from the atmosphere, with 41.0 grams (0.2067 mole) of freshly distilled 2-ethylhexyl methacrylate (EHMA) (the B monomer). Subsequently, 100 milliliters of freshly distilled tetrahydrofuran solvent, distilled from sodium benzophenone, was rinsed through the same alumina column into the polymerization flask. Subsequently, the GTP initiator, 0.9 milliliter of methyl trimethylsilyl dimethylketene acetal (0.772 grams; 0.00443 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.033 molar solution of tetrabutylammonium acetate (catalyst) in the same dry tetrahydrofuran was also syringed into the polymerization vessel. The contents of the polymerization vessel exothermed from 25° C. to about 60° C., and about 0.5 hour after the exotherm peaked, the temperature dropped back to about 25° C. Shortly thereafter, 4.5 grams (0.0286 mole) of freshly distilled 2-dimethylaminoethyl methacrylate (DMAEMA) (the A' monomer) was added to the polymerization vessel through a small (6 grams) dry alumina column and a small exotherm was noted from 25° C. to 29° C. After 15 minutes at this exotherm peak, the temperature again dropped back to 25° C., and then 4.5 grams (0.0284 mole) of freshly distilled trimethylsilyl methacrylate (the A' monomer) were passed through a second small (6 grams) dry alumina column into the reaction vessel. An additional 1.0 milliliter of the 0.033 molar solution of tetrabutylammonium acetate (catalyst) in dry tetrahydrofuran was then syringe added into the reaction vessel. A small exotherm, 25° C. to 26° C., was noted in about 20 minutes after the addition of the catalyst. After stirring for an additional hour at ambient temperature, 10 milliliters of methanol and 2 milliliter of tetrabutylammonium fluoride (as a 1.0M solution in THF) were added to the reaction vessel to quench the live ends of the triblock copolymer and to hydrolyze the silyl methacrylate repeat units to methacrylic acid repeat units. After stirring for another hour at ambient temperature, the contents of the reaction vessel were rotoevaporated to dryness at 50° to 60° C. and 40 to 50 millimeters Hg for about 1 hour, and then toluene was added to the solid residue to give a toluene solution containing 43.17 percent BAA' triblock copolymer solids.

The above charges of initiator and monomers provided an $M_n$ and average degree of polymerization (DP) for each block. For the EHMA nonpolar B block, the charged $M_n$ is 9,255 and the DP is 46.7. For the first polymerized DMAEMA polar A block, the charged $M_n$ was 1,016 and the DP was 6.5, and for the second polymerized trimethylsilyl methacrylate (TMSMA) polar A' block, the charged $M_n$ was also 1,016 and the DP was 6.4. The total charged molecular weight ($M_n$) prior to hydrolysis was 11,287. After complete hydrolytic removal of the trimethylsilyl group from the A' repeat unit of the BAA' triblock copolymer, the total charged molecular weight ($M_n$) was 10,824.

A small (3 to 4 grams) portion of the BAA' triblock copolymer was isolated for GPC analysis and nonaqueous titration by rotoevaporating the bulk of the toluene solvent from a 6 to 8 gram sample of the 43.17 percent toluene solution prepared above. The solid copolymer was then dried overnight (16 to 17 hours) in vacuo (about 0.5 Torr) at about 50° C. GPC analysis was obtained on a portion of the 3 to 4 gram sample of isolated solid polymer using four (100 A, 500 A, 1,000 A, and 10,000 Angstroms) WATERS ULTRASTYRAGEL™ columns in series onto which was injected a 50 microliter sample of this BAA' triblock copolymer at 0.2 percent (weight/volume) in THF. The sample on the GPC column was then eluted with THF at a flow rate of 1 milliliter/minute and the chromatogram was detected with a WATERS 410™ differential refractometer. The polystyrene equivalent number average molecular weight was found to be 7,380 and the weight average molecular weight was 14,350 resulting in a MWD of 1.94. Two nonaqueous titrations were performed on 1 gram samples of the dried BAA' triblock copolymer. The aliphatic amine groups in the DMAEMA A block repeat units were titrated with perchloric acid to give 0.605 milliequivalents of amine per gram of copolymer and the carboxylic acid groups in the methacrylic acid (MAA) A' block repeat units were titrated with potassium hydroxide to give 0.432 milliequivalents of acid per gram of copolymer. From these titration values the composition of the triblock copolymer was found to be (mole percent repeat units found versus calculated based on monomer charge) 80.8 versus 78.4 for the nonpolar 2-ethylhexyl methacrylate B block, 11.2 versus 10.8 for the polar 2-dimethylaminoethyl methacrylate A block, and 8.0 versus 10.8 for the polar methacrylic acid A' block. Conversion of the found mole percent composition to weight percent composition provides 86.6 percent 2-ethylhexyl methacrylate B block, 9.5 percent for the polar 2-dimethylaminoethyl methacrylate A block, and 3.7 percent for the polar methacrylic acid A' block. The BAA' triblock copolymer, poly[2-ethylhexyl methacrylate (B block)-co-N,N-dimethylamino-N-ethyl methacrylate (A block)-co-methacrylic acid (A' block)], prepared in this Example was used to prepare the charge directors in Examples VI through XI.

EXAMPLE III

BASE POLYMER PREPARATION 2

Sequential group transfer polymerization (GTP) of 2-ethylhexyl methacrylate (EHMA) and 2-dimethylaminoethyl methacrylate (DMAEMA) to prepare the BA diblock copolymer precursor, poly[2-ethylhexyl methacrylate (B block)-co-N,N-dimethylamino-N-ethyl methacrylate (A block)], of the hydrogen bromide ammonium salt BA diblock copolymer charge director was accomplished as follows.

The BA diblock copolymer precursor was prepared by a standard group transfer sequential polymerization procedure (GTP) wherein the 2-ethylhexyl methacrylate monomer was first polymerized to completion and then the 2-dimethylaminoethyl methacrylate monomer was polymerized onto the living end of the ethylhexyl methacrylate polymer. The calculated $M_n$ for this diblock copolymer is 3,946 based on grams of monomer charged and moles of initiator charged. All glassware was first baked out in an air convection oven at about 120° C. for about 16 to 18 hours.

A 2 liter 3-neck round bottom flask equipped with a magnetic stirring football, an Argon inlet and outlet, and a neutral alumina (150 grams) column (exchangeable with a rubber septum and a liquid dropping funnel) was charged through an alumina column, which was maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, were rinsed through the same alumina column into the polymerization flask vessel. Subsequently, the GTP initiator, 26 milliliters of methyl trimethylsilyl dimethylketene acetal (22.31 grams; 0.1280 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66 molar solution of tetrabutylammonium acetate (catalyst) in the same dry tetrahydrofuran was syringed into the polymerization vessel. After an additional 1 hour of stirring under Argon, the polymerization temperature peaked at about 50° C. Shortly thereafter, 90 grams (0.572 mole) of freshly distilled 2-dimethylaminoethyl methacrylate (DMAEMA) monomer were dropwise added to the polymerization vessel. The polymerization solution was stirred under Argon for at least 4 hours after the temperature peaked. Then, 5 milliliters of methanol were added to quench the live ends of the fully grown copolymer. The BA diblock copolymer in THF was not bulk isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) until no more solvent distilled over. Then, toluene was added to the solid polymeric residue to provide a solution of the BA diblock copolymer at any desired solids level.

The above charges of initiator and monomers provide an $M_n$ and average degree of polymerization (DP) for each block. For the EHMA nonpolar B block, the charged $M_n$ was 3,243 and the DP was 16.4, and for the DMAEMA polar A block, the charged $M_n$ was 703 and the DP was 4.5. A small (1 to 2 grams) portion of the BA diblock copolymer in THF solution was isolated for GPC and $^1$H-NMR analyses by precipitation into 10 times its solution volume of methanol using vigorous mechanical agitation. The precipitated copolymer was then washed on the funnel with more methanol and was then dried overnight in vacuo (about 0.5 Torr) at about 50° C.

$^1$H-NMR analysis of a 20 percent (g/dl) $CDCl_3$ solution of the isolated copolymer indicated a 77 to 78 mole percent EHMA content and a 22 to 23 mole percent DMAEMA content. GPC analysis was obtained on another portion of the 1 to 2 gram sample of isolated polymer using three 250×8 millimeters PHENOMENEX PHENOGEL™ columns in series (100, 500, 1000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. GPC analysis indicated the major peak at 14.5 to 19.9 counts. The major peak had a polystyrene equivalent number average molecular weight ($M_n$) of 3,912 and a weight average molecular weight ($M_w$) of 6,222 (MWD of 1.59). Two barely discernible broad low molecular weight peaks were located at 20 to 25.1 and 25.1 to 30 counts. Although the base copolymer prepared in this Example was not used to prepare charge directors, the base copolymer in Example IV, which is a scale-up of this Example, was used to prepare charge directors.

EXAMPLE IV

BASE POLYMER PREPARATION 3

A BA diblock copolymer precursor, poly[2-ethylhexyl methacrylate (B block)-co-N,N-dimethylamino-N-ethyl methacrylate (A block)], was prepared as described in Example III using the same polymerization procedure and conditions except the polymerization scale was increased by a factor of three. After solvent exchange, the resulting solution was 50.86 weight percent (solids) base polymer 3 in toluene. $^1$H-NMR analysis of a 17.5 percent (g/dl) $CDCl_3$ solution of an isolated portion of the BA diblock copolymer indicated about a 77 to 78 mole percent EHMA repeat unit content and a 22 to 23 mole percent DMAEMA repeat unit content. GPC analysis, as described in Example III, indicated the major peak at 14.4 to 22.6 counts to have a polystrene equivalent number average molecular weight of 2,253 and a weight average molecular weight of 5,978

(MWD of 2.65). A broad low molecular weight peak was located at 24 to 32 counts. The BA diblock copolymer, poly[2-ethylhexyl methacrylate (B block)-co-N,N-dimethylamino-N-ethyl methacrylate (A block)], prepared in this Example was used to prepare the charge director in Example XII.

EXAMPLE V

BASE POLYMER PREPARATION 4

Sequential group transfer polymerization (GTP) of 2-ethylhexyl methacrylate (EHM A) and 2-dimethylaminoethyl methacrylate (DMAEMA) to prepare the BA diblock copolymer precursor, poly[2-ethylhexyl methacrylate (B block)-co-N,N-dimethylamino-N-ethyl methacrylate (A block)], of the hydrogen bromide ammonium salt BA diblock copolymer charge director was accomplished as follows.

The BA diblock copolymer precursor was prepared by a standard sequential group transfer polymerization procedure (GTP) wherein the 2-ethylhexyl methacrylate monomer was first polymerized to completion and then the 2-dimethylaminoethyl methacrylate monomer was polymerized onto the living end of the ethylhexyl methacrylate polymer. The calculated $M_n$ for this diblock copolymer was 11,794 based on grams of monomer charged and moles of initiator charged. All glassware was first baked out in an air convection oven at about 120° C. for about 16 to 18 hours.

A 2 liter 3-neck round bottom flask equipped with a magnetic stirring football, an Argon inlet and outlet, and a neutral alumina (150 grams) column (exchangeable with a rubber septum and a liquid dropping funnel) was charged through an alumina column, which is maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, were rinsed through the same alumina column into the polymerization flask vessel. Subsequently, the GTP initiator, 8.7 milliliters of methyl trimethylsilyl dimethylketene acetal (7.47 grams; 0.0428 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.2 milliliter of a 1 weight percent solution of tetrabutylammonium acetate (catalyst) in the same dry tetrahydrofuran was syringed into the polymerization vessel. After an additional 1 hour of stirring under Argon, 90 grams (0.572 mole) of freshly distilled 2-dimethylaminoethyl methacrylate (DMAEMA) monomer were dropwise added to the polymerization vessel. The polymerization solution was stirred under Argon for at least 4 hours after the temperature peaked. Then, 5 milliliters of methanol were added to quench the live ends of the fully grown copolymer. The BA diblock copolymer in THF was not isolated but instead was solvent exchanged to provide the copolymer solution in toluene. Typically, the methanol quenched copolymer solution in tetrahydrofuran was rotoevaporated at about 50° C. at reduced pressure (40 to 50 millimeters Hg) until no more solvent distilled over. Then, toluene was added to the solid polymeric residue to provide a 50.05 weight percent solution of the BA diblock copolymer.

A small (3 to 4 grams) portion of the BA diblock copolymer was isolated from the toluene solution by rotoevaporating the bulk of the toluene solvent from a 6 to 8 gram sample of the 50.05 percent solution prepared above. The solid copolymer was then dried overnight (16 to 17 hours) in vacuo (about 0.5 Torr) at about 50° C. The solid copolymer sample was used for GPC analysis, $^1$H-NMR, and nonaqueous titration. GPC analysis was obtained on a portion of the 3 to 4 gram sample of isolated solid polymer using four (100, 500, 1,000, and 10,000 Angstroms) WATERS ULTRASTYRAGEL™ columns in series onto which was injected a 50 microliter sample of this BA diblock copolymer at 0.2 percent (weight/volume) in THF. The sample on the GPC column was then eluted with THF at a flow rate of 1 milliliter/minute, and the chromatogram was detected with a WATERS 410™ differential refractometer. The polystyrene equivalent number average molecular weight was found to be 7,970 and the weight average molecular weight was 14,400 giving a MWD of 1.76.

The above charges of initiator and monomers provided an $M_n$ and average degree of polymerization (DP) for each block. For the EHMA nonpolar B block, the charged $M_n$ was 9,692 and the DP was 48.9 and for the DMAEMA polar A block, the charged $M_n$ was 2,102 and the DP was 13.4. $^1$H-NMR analysis of a $CDCl_3$ solution of the isolated copolymer at about 20 percent (g/dl) indicated 78.55 mole percent EHMA (82.20 weight percent) and 21.45 mole percent DMAEMA (17.80 weight percent). The aliphatic amine groups in the DMAEMA A block repeat units of the copolymer were titrated with perchloric acid to give 1.140 milliequivalents of amine per gram of copolymer. The titrated amine content was converted to copolymer composition giving 78.41 mole percent EHMA (82.08 weight percent) and 21.59 mole percent DMAEMA (17.92 weight percent). Averaging the NMR and nonaqueous titration results provided a 21.52 mole percent (17.86 weight percent) DMAEMA content which compared favorably to the charged monomer molar quantities of 21.5 mole percent DMAEMA and 78.5 mole percent EHMA. This BA diblock copolymer was used in Example XIII to prepare the protonated charge director, poly[2-ethylhexyl methacrylate (B block)-co-N,N-dimethyl-N-ethyl methacrylate ammonium bromide (A block)].

EXAMPLE VI

CHARGE DIRECTOR PREPARATION 1

Preparation of the hydrogen bromide ammonium salt A block-BAA' triblock copolymer charge director, poly[2-ethylhexyl methacrylate (B block)-co-N,N-dimethyl-N-ethyl methacrylate ammonium bromide (A block)-co-methacrylic acid (A' block)], from poly[2-ethylhexyl methacrylate (B block)-co-N,N-dimethylamino-N-ethyl methacrylate (A block)-co-methacrylic acid (A' block)] prepared in Example II and aqueous hydrogen bromide.

To a 250 milliliter Erlenmeyer flask were added 15 grams of a 43.17 weight percent toluene solution of a BAA' triblock copolymer (6.48 grams) obtained from poly[2-ethylhexyl methacrylate (B block)-co-N,N-dimethylamino-N-ethyl methacrylate (A block)-co-methacrylic acid (A' block)] prepared in Example II comprised of 86.8 weight percent of 2-ethylhexyl methacrylate (EHMA) repeat units, 9.5 weight percent of 2-dimethylaminoethyl methacrylate (DMAEMA) repeat units and 3.7 weight percent of methacrylic acid (MAA) repeat units. The 6.48 grams of BAA' triblock copolymer contains 0.62 gram (0.00392 mole) of DMAEMA repeat units. To this magnetically stirred BAA' triblock copolymer toluene solution at about 20° C. were added an additional 3.96 grams of toluene, 0.99 gram of methanol, and 0.57 gram (0.00340 mole of HBr) of 48 percent aqueous hydrobromic acid (Aldrich). About 87 mole percent of the DMAEMA repeat units were targeted for conversion to the corresponding ammonium salt. The 32.95 weight percent polymer solution was magnetically stirred for about 20 hours at ambient temperature and was then diluted with 123.12 grams of NORPAR 15® to provide a 5 weight percent (based on the corresponding starting weight of the BAA' triblock copolymer from Example II) charge director solution after toluene and methanol rotoevaporation. The toluene and methanol were rotoevaporated for 1 hour at 55° to 60° C. at 40 to 60 millimeters Hg. The 5 weight percent NORPAR 15® solution of poly[2-ethylhexyl methacrylate (B block)-co-N,N-dimethyl-N-ethyl methacrylate ammonium bromide (A block)-co-methacrylic acid (A' block)] had a conductivity of 924 pmhos/cm, and was used to charge liquid toner as described in Example XIVA.

EXAMPLE VII

CHARGE DIRECTOR PREPARATION 2

Preparation of the methyl quaternized ammonium bromide A block-BAA' triblock copolymer charge director, poly[2-ethylhexyl methacrylate (B block)-co-N,N,N-trimethyl-N-ethyl methacrylate ammonium bromide (A block)-co-methacrylic acid (A' block)], from poly[2-ethylhexyl methacrylate (B block)-co-N,N-dimethylamino-N-ethyl methacrylate (A block)-co-methacrylic acid (A' block)] prepared in Example II and methyl bromide.

To a 250 milliliter Erlenmeyer flask were added 15 grams of a 43.17 weight percent toluene solution of a BAA' triblock copolymer (6.48 grams) obtained from poly[2-ethylhexyl methacrylate (B block)-co-N,N-dimethylamino-N-ethyl methacrylate (A block)-co-methacrylic acid (A' block)] prepared in Example II comprised of 86.8 weight percent of 2-ethylhexyl methacrylate (EHMA) repeat units, 9.5 weight percent of 2-dimethylaminoethyl methacrylate (DMAEMA) repeat units and 3.7 weight percent of methacrylic acid (MAA) repeat units. The 6.48 grams of BAA' triblock copolymer contain 0.62 gram (0.00392 mole) of DMAEMA repeat units. To this magnetically stirred BAA' triblock copolymer toluene solution at about 22° C. were added an additional 15.28 grams toluene and 2.05 milliliters (0.00409 mole) of a 2.0M solution of $CH_3Br$ in methyl t-butyl ether (Aldrich). All the DMAEMA repeat units were targeted for conversion to the corresponding methyl bromide quaternized ammonium repeat units. The 21.4 weight percent polymer solution was magnetically stirred for about 21.5 hours at ambient temperature and was then diluted with 123.12 grams of ISOPAR M® to provide a 5 weight percent (based on the corresponding starting weight of the BAA' triblock copolymer from Example II) charge director solution after toluene rotoevaporation. The toluene-ISOPAR M® solution of charge director was split into approximately two equal portions. One portion was rotoevaporated as is to remove the toluene and to the other was added methanol (about 33 percent versus the volume of charge director solution), and then the toluene and methanol were rotoevaporated. Rotoevaporation of each portion was carried out for 0.75 hour at 60° to 65° C. and 40 to 60 millimeters Hg. The 5 weight percent ISOPAR M® solutions of poly[2-ethylhexyl methacrylate (B block)-co-N,N,N-trimethyl-N-ethyl methacrylate ammonium bromide (A block)-co-methacrylic acid (A' block)] had a conductivity of 1,411 and 1,060 pmhos/cm, respectively, and were used to charge liquid toner as described in Example XIVB.

EXAMPLE VIII

CHARGE DIRECTOR PREPARATION 3

Preparation of the methyl quaternized ammonium A block/carboxylate A' block inter-repeat unit Zwitter ion-co-methyl quaternized ammonium bromide A block-BAA' triblock copolymer charge director, poly[2-ethylhexyl methacrylate (B block)-co-N,N,N-trimethyl-N-ethyl methacrylate ammonium (A block)/methacrylate (A' block) Zwitter ion-co-N,N,N-trimethyl-N-ethyl methacrylate ammonium bromide (A block)], from poly[2-ethylhexyl methacrylate (B block)-co-N,N-dimethylamino-N-ethyl methacrylate (A block)-co-methacrylic acid (A' block)] prepared in Example II and (1) methyl bromide, and then (2) sodium hydride.

To a 250 milliliter Erlenmeyer flask were added 15 grams of a 43.17 weight percent toluene solution of a BAA' triblock copolymer (6.48 grams) obtained from poly[2-ethylhexyl methacrylate (B block)-co-N,N-dimethylamino-N-ethyl methacrylate (A block)-co-methacrylic acid (A' block)] prepared in Example II comprised of 86.8 weight percent of 2-ethylhexyl methacrylate (EHMA) repeat units, 9.5 weight percent of 2-dimethylaminoethyl methacrylate (DMAEMA) repeat units and 3.7 weight percent of methacrylic acid (MAA) repeat units. The 6.48 grams of BAA' triblock copolymer contains 0.62 gram (0.00392 mole) of DMAEMA repeat units. To this magnetically stirred BAA' triblock copolymer toluene solution at about 22° C. were added an additional 15.28 grams of toluene and 1.92 milliliters (0.002384 mole) of a 2.0M solution of $CH_3Br$ in methyl t-butyl ether (Aldrich). About 98 mole percent of the DMAEMA repeat units were targeted for conversion to the corresponding methyl bromide quaternized ammonium repeat units. The mole percent of methyl bromide quaternized DMAEMA ammonium repeat units at complete conversion is about 11.2×98=11.0 mole percent based on the initially titrated DMAEMA repeat unit content in Example II. The 21.4 weight percent polymer solution was magnetically stirred for about 22 hours at ambient temperature. To this solution was added 0.136 gram (0.00280 mole) of a 50 weight percent dispersion of sodium hydride (NaH) in mineral oil (Alfa). Copious evolution of hydrogen gas immediately followed and the mixture was magnetically stirred for an additional 4 hours. All the methacrylic acid repeat units were targeted for conversion to sodium methacrylate repeat units with this equimolar charge of sodium hydride. The mole percent of sodium methacrylate repeat units at complete conversion is about 8.00×1.0=8.00 mole percent based on the initially titrated methacrylic acid (MAA) repeat unit content in Example II. After the formation of NaBr, there remains (11.0 to 8.00) about 3 mole percent of methyl quaternized DMAEMA ammonium bromide repeat units (block A), 16 mole percent (8 mole percent each) of the inter-repeat unit Zwitter ion from block A (as the quaternized ammonium group) and block A' (as the carboxylate anion), and about 81 mole percent of the original EHMA repeat units. The resulting dispersion was then vacuum filtered through a 934-AH Whatman microfiber filter pad to remove any sodium bromide by product that may have precipitated. To the filtrate were added 123.12 grams of ISOPAR M® to provide a 5 weight percent (based on the corresponding starting weight of the BAA' triblock copolymer from Example II) charge director solution after toluene rotoevaporation. The toluene-ISOPAR M® solution of charge director was split into approximately two equal portions. One portion was rotoevaporated as is to remove the toluene and to the other was added methanol (about 33 percent versus the volume of charge director solution), and then the toluene and methanol were rotoevaporated. Rotoevaporation of each portion was carried out for 0.75 hour at 60° to 65° C. and 40 to 60 millimeters Hg. The 5 weight percent ISOPAR M® solutions of poly[2-ethylhexyl methacrylate (B block)-co-N,N,N-trimethyl-N-ethyl methacrylate ammonium (A block)/methacrylate (A' block) Zwitter ion-co-N,N,N-trimethyl-N-ethyl methacrylate ammonium bromide (A block)] had conductivities of 1,490 and 890 pmhos/centimeters, respectively, and were used to charge liquid toner as described in Example XIVC.

EXAMPLE IX

CHARGE DIRECTOR PREPARATION 4

Preparation of the methyl quaternized ammonium A block/carboxylate A' block inter-repeat unit Zwitter ion-co-methyl quaternized ammonium bromide A block-BAA' triblock copolymer charge director, poly[2-ethylhexyl methacrylate (B block)-co-N,N,N-trimethyl-N-ethyl methacrylate ammonium (A block)/methacrylate (A' block) Zwitter ion-co-N,N,N-trimethyl-N-ethyl methacrylate ammonium bromide (A block)], from poly[2-ethylhexyl methacrylate (B block)-co-N,N-dimethylamino-N-ethyl methacrylate (A block)-co-methacrylic acid (A' block)] prepared in Example II and (1) methyl bromide, and then (2) zirconium hydride.

To a 250 milliliter Erlenmeyer flask were added 15 grams of a 43.17 weight percent toluene solution of a BAA' triblock copolymer (6.48 grams) obtained from poly[2-ethylhexyl methacrylate (B block)-co-N,N-dimethylamino-N-ethyl methacrylate (A block)-co-methacrylic acid (A' block)] prepared in Example II comprised of 86.8 weight percent of 2-ethylhexyl methacrylate (EHMA) repeat units, 9.5 weight percent of 2-dimethylaminoethyl methacrylate (DMAEMA) repeat units and 3.7 weight percent of methacrylic acid (MAA) repeat units. The 6.48 grams of BAA' triblock copolymer contains 0.62 gram (0.00392 mole) of DMAEMA repeat units. To this magnetically stirred BAA' triblock copolymer toluene solution at about 22° C. were added an additional 15.28 grams of toluene and 1.92 milliliters (0.00384 mole) of a 2.0M solution of $CH_3Br$ in methyl t-butyl ether (Aldrich). About 98 mole percent of the DMAEMA repeat units were targeted for conversion to the corresponding methyl bromide quaternized ammonium repeat units. The mole percent of methyl bromide quaternized DMAEMA ammonium repeat units at complete conversion is about 11.2×98=11.0 mole percent based on the initially titrated DMAEMA repeat unit content in Example II. The 21.4 weight percent polymer solution was magnetically stirred for about 22.5 hours at ambient temperature. To this solution was added 0.204 gram (0.00219 mole) of zirconium hydride ($ZrH_2$) (Aldrich 99 percent-325 mesh). Evolution of hydrogen gas followed and the mixture was magnetically stirred for an additional 4 hours. All the methacrylic acid repeat units were targeted for conversion to sodium methacrylate repeat units with this charge of zirconium hydride assuming each hydride reacts with one carboxylic acid group. The mole percent of sodium methacrylate repeat units at complete conversion is about 8.00×1.0=8.00 mole percent based on the initially titrated methacrylic acid (MAA) repeat unit content in Example II. After NaBr formation, there remains (11.0 to 8.00) about 3 mole percent of methyl quaternized DMAEMA ammonium bromide repeat units (block A), 16 mole percent (8 mole percent each) of the inter-repeat unit Zwitter ion from block A (as the quaternized ammonium group) and block A' (as the carboxylate anion), and about 81 mole percent of the original EHMA repeat units. The resulting dispersion was then vacuum filtered through a 934-AH Whatman microfiber filter pad to remove any zirconium bromide byproduct that may have precipitated. To the filtrate were added 123.12 grams of ISOPAR M® to provide a 5 weight percent (based on the corresponding starting weight of the BAA' triblock copolymer from Example II) charge director solution after toluene rotoevaporation. The toluene-ISOPAR M® solution of charge director was split into approximately two equal portions. One portion was rotoevaporated as is to remove the toluene and to the other was added methanol (about 33 percent versus the volume of charge director solution) and then the toluene and methanol were rotoevaporated. Rotoevaporation of each portion was carried out for 0.60 hour at 60° to 65° C. and 40 to 60 millimeters Hg. The 5 weight percent ISOPAR M® solutions of poly[2-ethylhexyl methacrylate (B block)-co-N,N,N-trimethyl-N-ethyl methacrylate ammonium (A block)/methacrylate (A' block) Zwitter ion-co-N,N,N-trimethyl-N-ethyl methacrylate ammonium bromide (A block)] had conductivities of 1,195 and 874 pmhos/centimeters, respectively, and were used to charge liquid toner as described in Example XIVD.

EXAMPLE X

CHARGE DIRECTOR PREPARATION 5

Preparation of the zirconium carboxylate salt BAA' triblock copolymer charge director, poly[2-ethylhexyl methacrylate (B block)-co-N,N-dimethylamino-N-ethyl methacrylate (A block)-co-zirconium methacrylate (A' block)], from poly[2-ethylhexyl methacrylate (B block)-co-N,N-dimethylamino-N-ethyl methacrylate (A block)-co-methacrylic acid (A' block)] prepared in Example II and zirconium hydride.

To a 250 milliliter Erlenmeyer flask were added 15 grams of a 43.17 weight percent toluene solution of a BAA' triblock copolymer (6.48 grams) obtained from poly[2-ethylhexyl methacrylate (B block)-co-N,N-dimethylamino-N-ethyl methacrylate (A block)-co-methacrylic acid (A' block)] prepared in Example II comprised of 86.8 weight percent of 2-ethylhexyl methacrylate (EHMA) repeat units, 9.5 weight percent of 2-dimethylaminoethyl methacrylate (DMAEMA) repeat units and 3.7 weight percent of methacrylic acid (MAA) repeat units. The 6.48 grams of BAA' triblock copolymer contains 0.62 gram (0.00392 mole) of DMAEMA repeat units. To this magnetically stirred BAA' triblock copolymer toluene solution at about 22° C. were added an additional 15.28 grams of toluene and 0.201 gram (0.00215 mole) of zirconium hydride ($ZrH_2$) (Aldrich 99 percent-325 mesh). Evolution of hydrogen gas followed and the resulting mixture at 21.4 weight percent solids was magnetically stirred for an additional 22.75 hours. All the methacrylic acid repeat units were targeted for conversion to the corresponding methacrylate anion repeat units with this charge of zirconium hydride assuming each hydride reacts with one carboxylic acid group. The molar quantity of methacrylate anion repeat units at complete conversion is about 8.00×1.0=8.00 mole percent based on the titrated methacrylic acid (MAA) repeat unit content in Example II.

Thus, the product copolymer is about 11 mole percent of unmodified DMAEMA repeat units (A block), 8 mole percent of zirconium carboxylate repeat units (A' block), and 81 mole percent of unmodified EHMA repeat units (B block). The resulting dispersion was then vacuum filtered through a 934-AH Whatman microfiber filter pad to remove any unreacted insoluble zirconium hydride. To the filtrate were added 123.12 grams of ISOPAR M® to provide a 5 weight percent (based on the corresponding starting weight of the BAA' triblock copolymer from Example II) charge director solution after toluene rotoevaporation. The toluene-ISOPAR M® solution of charge director was again filtered as above and then was rotoevaporated at 60° to 65° C. and 40 to 60 millimeters Hg for 0.60 hour to remove the toluene. The 5 weight percent of ISOPAR M® solution of poly[2-ethylhexyl methacrylate (B block)-co-N,N-dimethylamino-N-ethyl methacrylate (A block)-co-zirconium methacrylate (A' block)] had a conductivity of 584 pmhos/centimeter, and was used to charge liquid toner as described in Control 3.

EXAMPLE XI

CHARGE DIRECTOR PREPARATION 6

Preparation of the charge director solution from the nitrogen unmodified BAA' triblock copolymer, poly[2-ethylhexyl methacrylate (B block)-co-N,N-dimethylamino-N-ethyl methacrylate (A block)-co-methacrylic acid (A' block)], as prepared in Example II.

Three (3.00) grams of the 43.17 weight percent toluene solution of poly[2-ethylhexyl methacrylate (B block)-co-N,N-dimethylamino-N-ethyl methacrylate (A block)-co-methacrylic acid (A' block)] prepared in Example II was rotoevaparated for 1 hour at about 60° C. and at 40 to 60 millimeters Hg to remove the bulk of the solvent. To the 1.68 gram residue which contained 1.30 grams of the triblock copolymer and 0.38 gram of trapped toluene were added 24.42 grams of ISOPAR M® to give a 5.0 weight percent solution of poly[2-ethylhexyl methacrylate (B block)-co-N,N-dimethylamine-N-ethyl methacrylate (A block)-co-methacrylic acid (A' block)] in ISOPAR M® (98.5 percent)/toluene (1.5 percent). This charge director solution had a conductivity of 616 pmho/centimeter, and was used to charge liquid toner as described in Control 2.

EXAMPLE XII

CHARGE DIRECTOR PREPARATION 7

Preparation of the protonated ammonium bromide BA diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)], prepared in Example IV (calculated $M_n$ of 3,946 as in Example III) and aqueous hydrogen bromide.

To a 4.0 liter Erlenmeyer flask were added 637.1 grams of a 50.86 weight percent toluene solution of the BA diblock copolymer (324.0 grams copolymer and 313.1 grams toluene) prepared from poly(2-ethylhexyl methacrylate-co-N,N-dimethylamino-N-ethyl methacrylate) described in Example IV. The BA diblock copolymer was comprised of 18.25 weight percent of 2-dimethylaminoethyl methacrylate (DMAEMA) repeat units and 81.75 weight percent of 2-ethylhexyl methacrylate (EHMA) repeat units. The 324.0 grams of BA diblock copolymer contained 59.1 grams (0.376 mole) of DMAEMA repeat units. To this magnetically stirred BA diblock copolymer toluene solution at about 20° C. were added an additional 324.0 grams of toluene, 50.5 grams of methanol, and 62.1 grams (0.368 mole of HBr) of 48 percent aqueous hydrobromic acid (Aldrich). The charged solids level was 32.95 weight percent, assuming a quantitative conversion of the targeted 98 mole percent of DMAEMA repeat units present in the base polymer, to the HBr salt. This solution was magnetically stirred for about 66 hours at ambient temperature to give a low molecular weight protonated ammonium bromide BA diblock charge director solution. The moderately viscous solution was then diluted with 6,156.6 grams of NORPAR 15® to give a 5 weight percent (based on the corresponding starting weight of the BA diblock copolymer from Example IV) charge director solution after toluene and methanol rotoevaporation. Toluene and methanol were rotoevaporated in 0.5 liter batches at 50° to 60° C. for 1.0 to 1.5 hours at 40 to 60 millimeters Hg. The 5 weight percent NORPAR 15® solution batches of poly(2-ethylhexyl methacrylate-co-N,N-dimethyl-N-ethyl methacrylate ammonium bromide) had conductivities in the range of 1,970 to 2,110 pmhos/centimeter and were used to charge liquid toner in Control 1A.

EXAMPLE XIII

CHARGE DIRECTOR PREPARATION 8

Preparation of the protonated ammonium bromide BA diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)], prepared in Example V (calculated $M_n$ of 11,794) and aqueous hydrogen bromide.

To a 0.5 liter Erlenmeyer flask were added 150.0 grams of a 50.05 weight percent toluene solution of the BA diblock copolymer (75.08 grams of copolymer and 74.92 grams of toluene) prepared from poly(2-ethylhexyl methacrylate-co-N,N-dimethylamino-N-ethyl methacrylate) described in Example V. The BA diblock copolymer is comprised of 17.86 weight percent of 2-dimethylaminoethyl methacrylate (DMAEMA) repeat units and 82.14 weight percent of 2-ethylhexyl methacrylate (EHMA) repeat units. The 75.08 grams of BA diblock copolymer contained 13.41 grams (0.0853 mole) of DMAEMA repeat units. To this magnetically stirred BA diblock copolymer toluene solution at about 20° C. were added an additional 120.4 grams of toluene, 27.7 grams of methanol, and 14.1 grams (0.0836 mole of HBr) of 48 percent aqueous hydrobromic acid (Aldrich). The charged solids level was 26.21 weight percent, assuming a quantitative conversion of the targeted 98 mole percent of DMAEMA repeat units present in the base polymer, to the HBr salt. This solution was magnetically stirred for about 21.5 hours at ambient temperature to provide a low molecular weight protonated ammonium bromide BA diblock charge director solution. The moderately viscous solution was then diluted with 1,423.9 grams of NORPAR 15® to give a 5 weight percent (based on the corresponding starting weight of the BA diblock copolymer from Example V) charge director solution after toluene and methanol rotoevaporation. Toluene and methanol were rotoevaporated in 0.5 liter batches at 50° to 60° C. for 1.0 to 1.5 hours at 40 to 60 millimeters Hg. The 5 weight percent NORPAR 15® solution batches of poly(2-ethylhexyl methacrylate-co-N,N-dimethyl-N-ethyl methacrylate ammonium bromide) remaining after rotoevaporation were combined and the combined batch had a conductivity of 447 pmhos/centimeters. This 5 percent charge director solution was used to charge the liquid toner in Control 1B.

CONTROL 1

CYAN LIQUID DEVELOPERS CHARGED WITH NITROGEN PROTONATED AMMONIUM BROMIDE SALT BA DIBLOCK COPOLYMER CHARGE DIRECTORS

Two cyan liquid toner dispersions were prepared by selecting 13.57 grams of liquid toner concentrate (7.37 percent solids in ISOPAR M®) from Example I and adding to it sufficient ISOPAR M® (Exxon) and Superla White Mineral Oil (Amoco) and 5 percent of AB diblock protonated charge director, poly[2-ethylhexyl methacrylate (B block)-co-N,N-dimethyl-N-ethyl methacrylate ammonium bromide (A block)], from Examples XII (calculated $M_n$ of pre-protonated block copolymer=3,946) and XIII (calculated $M_n$ of pre-protonated block copolymer=11,794) to provide 1 percent solids (wherein solids include resin, charge adjuvant, and cyan pigment) liquid toner dispersions containing 30 and 50 milligrams or 3 and 5 percent of charge director per gram of toner solids (Controls 1A and 1B). The two 5 percent BA diblock charge directors used in this control were prepared from base polymer preparations 3 and 4 in Examples IV and V, respectively. After 2 and 8 days of equilibration, mobility and conductivity were measured for these 1 percent liquid toners to determine the toner charging rate and level. These values were compared to mobility and conductivity values obtained for the 1 percent cyan liquid toners described in Example XIV containing 50 milligrams or 5 percent of nitrogen alkylated or protonated BAA' triblock copolymer charge director per gram of toner solids after the same equilibration time periods. Table 1 in Example XIV contains 100 gram formulations for cyan liquid toners or developers charged with the protonated BA diblock and the protonated and alkylated BAA' triblock copolymer charge directors. Table 2 contains the corresponding mobility and conductivity values for these cyan liquid toners or developers.

CONTROL 2

CYAN LIQUID DEVELOPER CHARGED WITH THE NITROGEN UNMODIFIED BAA' TRIBLOCK COPOLYMER CHARGE DIRECTOR

One cyan liquid toner dispersion was prepared by selecting 13.57 grams of liquid toner concentrate (7.37 percent solids in ISOPAR M®) from Example I and adding to it sufficient ISOPAR M® (Exxon) and Superla White Mineral Oil (Amoco) and 5 percent of nitrogen unmodified BAA' triblock charge director, poly[2-ethylhexyl methacrylate (B block)-co-N,N-dimethylamino-N-ethyl methacrylate (A block)-co-methylacrylic acid (A' block)], from Example II (same as base polymer 1) to provide a 1 percent solids (wherein solids include resin, charge adjuvant, and cyan pigment) liquid toner dispersion containing 50 milligrams or 5 percent of charge director per gram of toner solids (Controls 2). The 5 percent nitrogen unmodified BAA' triblock charge director used in this control was prepared by dissolving base polymer 1 from Example II in ISOPAR M®. After 2 and 8 days of equilibration, mobility and conductivity were measured for this 1 percent liquid toner to determine the toner charging rate and level. This value was compared to mobility and conductivity values obtained for the 1 percent cyan liquid toners described in Example XIV containing the same concentrations of nitrogen alkylated or protonated BAA' triblock copolymer charge directors after the same equilibration time periods. Table 1 contains 100 gram formulations for the cyan liquid toner or developers charged with the nitrogen unmodified BAA' triblock and the nitrogen alkylated and protonated BAA' triblock copolymer charge directors. Table 2 contains the corresponding mobility and conductivity values for these cyan liquid toners or developers.

CONTROL 3

CYAN LIQUID DEVELOPER CHARGED WITH THE ZIRCONIUM CARBOXYLATE SALT BAA' TRIBLOCK COPOLYMER CHARGE DIRECTOR

One cyan liquid toner dispersion was prepared by selecting 13.57 grams of liquid toner concentrate (7.37 percent solids in ISOPAR M®) from Example I and adding to it sufficient ISOPAR IVI® (Exxon) and Superla White Mineral Oil (Amoco), and 5 percent of zirconium salt BAA' triblock charge director, poly[2-ethylhexyl methacrylate (B block)-co-N,N-dimethylamino-N-ethyl methacrylate (A block)-co-zirconium methacrylate (A' block)], from Example X to provide a 1 percent solids (wherein solids include resin, charge adjuvant, and cyan pigment) liquid toner dispersion containing 50 milligrams or 5 percent of charge director per gram of toner solids (Control 3). After 2 and 8 days of equilibration, mobility and conductivity were measured for this 1 percent liquid toner to determine the toner charging rate and level. This value was compared to mobility and conductivity values obtained for the 1 percent cyan liquid toners described in Example XIV containing the same concentrations of nitrogen alkylated or protonated BAA' triblock copolymer charge directors after the same equilibration time periods. Table 1 contains 100 gram formulations for the cyan liquid toner or developers charged with the zirconium carboxylate salt BAA' triblock and the nitrogen alkylated and protonated BAA' triblock copolymer charge directors. Table 2, following Example XIV, contains the corresponding mobility and conductivity values for these cyan liquid toners, or liquid or developers.

EXAMPLE XIV

CYAN LIQUID DEVELOPERS CHARGED WITH NITROGEN ALKYLATED AND PROTONATED BAA' TRIBLOCK COPOLYMER CHARGE DIRECTORS

Cyan liquid toner dispersions were prepared by selecting 13.57 grams of liquid toner concentrate (7.37 percent solids in ISOPAR M®) from Example I and adding to it sufficient ISOPAR M® (Exxon) and Superla White Mineral Oil (Amoco), and 5 percent of BAA' triblock copolymer charge director from Examples VI to IX to provide 1 percent solids (wherein solids include resin, charge adjuvant, and pigment) liquid toner dispersions containing 50 milligrams or 5 percent of charge director per gram of toner solids (Examples XIVA to XIVD). The 5 percent BAA' triblock copolymer charge directors were prepared from base polymer preparation 1 in Example II. After 2 and 8 days of equilibration, mobility and conductivity were measured for these 1 percent liquid toners to determine the toner charging rate and level. These values were compared to mobility and conductivity values obtained for the 1 percent cyan liquid toners described in Controls 1, 2, and 3 containing the same or similar concentrations of (Control 1) nitrogen protonated ammonium salt BA diblock copolymer charge directors, (Control 2) nitrogen unmodified BAA' triblock copolymer charge director, and (Control 3) the zirconium carboxylate salt BAA' triblock copolymer charge director after the same equilibration time periods. Table 1 contains 100 gram formulations for cyan liquid toners or developers charged with the charge directors prepared in Controls 1, 2, and 3 as well as the nitrogen alkylated and protonated BAA' triblock copolymer charge directors of this invention. Table 2 contains the corresponding mobility and conductivity values for these cyan liquid toners or developers.

TABLE 1

Cyan Liquid developer Formulations Charged with (1) Nitrogen Protonated Ammonium Bromide Salt BA Diblock, (2) Nitrogen Unmodified BAA' Triblock, (3) Zirconium Carboxylate Salt BAA' Triblock, (4) Nitrogen Alkylated and Protonated BAA' Triblock and (5) Nitrogen Alkyl Quat/carboxylate Anion Inter-repeat Unit Zwitter Ion BAA' Triblock Copolymer Charge Directors

| Developer ID: Control or Example No. | Grams Toner Concentrate From Example I | Grams Added Isopar M | Grams Added Superla White Mineral Oil No. 5 | Grams Added 5% Charge Director (CD) in Hydro-carbon | Ex. No. of CD Prep. and CD Level in mg CD/g Toner Solids |
|---|---|---|---|---|---|
| Control 1A | 13.57 | 36.33 | 49.50 | 0.60 | Ex. XII: 30/1 BA |
| Control 1B | 13.57 | 35.93 | 49.50 | 1.00 | Ex. XIII: 50/1 BA |
| Control 2 | 13.57 | 35.93 | 49.50 | 1.00 | Ex. XI: 50/1 unmodified BAA' |
| Control 3 | 13.57 | 35.93 | 49.50 | 1.00 | Ex. X: 50/1 BAA' Zr carboxylate salt |
| Example XIVA | 13.57 | 35.93 | 49.50 | 1.00 | Ex. VI: 50/1 BAA' HBr salt |
| Example XIVB | 13.57 | 35.93 | 49.50 | 1.00 | Ex. VII: 50/1 BAA' methyl bromide quat |
| Example XIVC | 13.57 | 35.93 | 49.50 | 1.00 | Ex. VIII: 50/1 BAA' + N-methyl and $CO_2$-Zwitter Ion (NaBr byproduct) |
| Example XIVD | 13.57 | 35.93 | 49.50 | 1.00 | Ex. IX: 50/1 BAA' + N-methyl and $CO_2$-Zwitter Ion ($ZrBr_2$ byproduct) |

CD = Charge Director

TABLE 2

Mobility and Conductivity Results For Cyan Liquid Developers Charged With (1) Nitrogen Protonated Ammonium Bromide Salt BA Diblock, (2) Nitrogen Unmodified BAA' Triblock, (3) Zirconium Carboxylate Salt BAA' Triblock, (4) Nitrogen Alkylated and Protonated BAA' Triblock, and (5) Nitrogen Alkyl Quat/carboxylate Anion Inter-repeat Unit Zwitter Ion BAA' Triblock Copolymer Charge Directors

| Developer ID: Control or Example No. | Aging Time in Days | CD Level in mg CD/g Toner Solids and CD Description | Mobility E-10 $m^2$/Vs | Cond. pmho/cm | Comments |
|---|---|---|---|---|---|
| Control 1A | 2<br>8 | 30/1 BA diblock HBr salt copolymer | −2.96<br>−3.11 | 6.8<br>6.0 | High charging and medium conductivity |
| Control 1B | 2<br>8 | 50/1 BA diblock HBr salt copolymer | −2.99<br>−3.07 | 4.5<br>4.0 | High charging and low conductivity |
| Control 2 | 5 | 50/1 BAA' triblock unmodified copolymer | −0.87 | 6.0 | Very low charging and medium conductivity |
| Control 3 | 2<br>8 | 50/1 BAA' triblock Zr carboxylate salt copolymer | −1.78<br>−1.79 | 6.4<br>5.7 | Low charging and medium conductivity |
| Example XIVA | 2<br>8 | 50/1 BAA' triblock HBr salt copolymer | −3.52<br>−3.53 | 7.0<br>6.4 | Very high charging and medium conductivity |
| Example XIVB | 2<br>8 | 50/1 BAA' triblock MeBr quat copolymer | −3.36<br>−3.41 | 8.9<br>7.8 | Very high charging & medium |

TABLE 2-continued

Mobility and Conductivity Results For Cyan Liquid Developers Charged With (1) Nitrogen Protonated Ammonium Bromide Salt BA Diblock, (2) Nitrogen Unmodified BAA' Triblock, (3) Zirconium Carboxylate Salt BAA' Triblock, (4) Nitrogen Alkylated and Protonated BAA' Triblock, and (5) Nitrogen Alkyl Quat/carboxylate Anion Inter-repeat Unit Zwitter Ion BAA' Triblock Copolymer Charge Directors

| Developer ID: Control or Example No. | Aging Time in Days | CD Level in mg CD/g Toner Solids and CD Description | Mobility E-10 $m^2$/Vs | Cond. pmho/cm | Comments |
|---|---|---|---|---|---|
| | | | | | conductivity |
| | 2 | Same + MeOH | −3.54 | 8.3 | |
| | 8 | treatment | −3.52 | 7.8 | |
| Example XIVC | 2 | 50/1 BAA' triblock | −3.28 | 8.3 | Very high charging and medium conductivity |
| | 8 | MeBr quat/carboxylate Zwitter ion [NaBr byproduct] | −3.27 | 7.6 | |
| | 2 | Same + MeOH | −3.39 | 7.9 | |
| | 8 | treatment | −3.38 | 7.1 | |
| Example XIVD | 2 | 50/1 BAA' triblock | −3.41 | 8.1 | Very high charging and medium conductivity |
| | 8 | MeBr quat/carboxylate Zwitter ion [$ZrBr_2$ byproduct] | −3.32 | 7.2 | |
| | 2 | Same + MeOH | −3.58 | 7.7 | |
| | 8 | treatment | −3.47 | 6.7 | |

A review of Tables 1 and 2 reveals that cyan developers charged with either the N-protonated or N-methylated BAA' triblock ammonium bromide quat or salt copolymer charge directors (Examples XIVA and XIVB) provided higher mobilities after 2 and 8 days of charging and did so more rapidly in 2 days than (1) either of the two protonated BA diblock ammonium bromide salt copolymer charge directors (Controls 1A, 1B), (2) the unmodified BAA' triblock copolymer charge director (Control 2), (3) the zirconium carboxylate BAA' triblock copolymer charge director (Control 3). In addition, the inter-repeat unit Zwitter ion containing charge directors (Examples XIVC and XIVD) containing an N-methylated quaternized nitrogen in the A repeat unit and a carboxylate anion in the A' repeat unit also provided higher mobilities in cyan developers after 2 and 8 days of charging and did so more rapidly in the 2 days than did the above controls after the same time. The presence of small amounts of residual inorganic salts (either NaBr or $ZrBr_2$) in the Zwitter ion containing charge directors does not significantly decrease charging rate and level or increase conductivity in cyan developers charged with these charge directors. Higher developer mobilities at comparable conductivity levels resulted for all the developers versus the four controls. Methanol treatment of the charge director solution prior to charging the cyan developers had little impact on developer charging rate and level or conductivity.

In contrast, U.S. Ser. No. 314,752, the disclosure of which is totally incorporated herein by reference, illustrates BA diblock N-methylated ammonium bromide quat copolymer charge directors (which contain no methacrylic acid A' block, but otherwise are the same as the BAA' triblock N-methylated ammonium bromide quat copolymer charge directors used in this invention) require the methanol pretreatment of the CD solution to obtain a comparable charging level in cyan developers charged therewith at the same concentration of charge director in the liquid toner formulation. Thus, the presence of the carboxylic acid or carboxylic acid derivative repeat unit in the BAA' triblock ammonium copolymer charge directors of this invention eliminates the need to pretreat the charge director solution with a lower alcohol prior to charging liquid toner with said charge director.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of a nonpolar liquid, thermoplastic resin particles, a charge adjuvant, pigment, and a charge director selected from the group consisting of the triblock polymers BAA', BA'A, and ABA' wherein A, A' and B represent polymer segments or blocks, the polar A block repeat units contain an alkylated or protonated ammonium charged site and the polar A' block repeat units contain an acid group of a pKa equal to or less than about 7.0, and wherein the nonpolar B block repeat units contain aliphatic hydrocarbon solubilizing groups; and wherein the A and A' block number average molecular weights range from about 200 to 120,000, and the B block number average molecular weights range from about 2,000 to 190,000; and the total number average molecular weight of said charge director is from about 2,400 to about 300,000, and the ratio of $M_w$ to $M_n$ for said charge director is 1 to 5.

2. A negatively charged liquid electrostatographic developer comprised of a nonpolar liquid, resin particles, pigment, a charge adjuvant, and a polymeric ionic charge director selected from the group consisting of triblock polymers BAA', BA'A, and ABA' wherein A, A' and B represent polymer segments or blocks in which the polar A block repeat units contain an alkylated or protonated ammonium charged site, and in which the polar A' block repeat units contain an acid group of a pKa equal to or less than about 7.0, and in which the nonpolar B block repeat units contain aliphatic hydrocarbon solubilizing groups wherein the A and A' block number average molecular weights range from about 200 to 120,000 and the B block number average molecular weights range from about 2,000 to 190,000, and the total number average molecular weight for said polymeric ionic charge director is from about 2,400 to about 300,000, and the ratio of $M_w$ to $M_n$ for said charge director is 1 to 5.

3. A liquid developer comprised of a liquid, thermoplastic resin particles, pigment, a charge director triblock polymer of the formulas BAA', BA'A, and ABA' wherein the nonpolar B blocks or segments are poly(2-ethylhexyl methacrylate), poly(2-ethylhexyl acrylate), poly(lauryl methacrylate), poly(lauryl acrylate), poly(tertiary butyl styrene), poly(myrcene), or poly(N,N-dibutylmethacrylamide), and wherein non-Zwitter ion alkylated and protonated ammonium containing polar A blocks or segments are poly(N,N-dimethylammoniumethyl methacrylate bromide), poly(N,N-dimethylammoniumethyl acrylate bromide), poly(N,N,N-trimethylammoniumethyl methacrylate bromide), poly(N,N,N-trimethylammoniumethyl acrylate bromide), poly(N,N-diethylammoniumethyl methacrylate bromide), poly(N,N-diethylammoniumethyl acrylate bromide), poly(N,N,N-triethylammoniumethyl methacrylate bromide), poly(N,N,N-triethylammoniumethyl acrylate bromide), poly(2,3, or 4-vinyl-N-methylpyridinium bromide), or poly(2,3, or 4-vinylpyridinium bromide); and wherein the non-Zwitter ion free acid containing polar A' blocks or segments are poly(methacrylic acid), poly(acrylic acid), poly(4-vinylbenzoic acid), poly(4-vinyl-1-naphthoic acid), poly(5-vinyl-2-carboxythiophene), poly(5-vinyl-2-carboxyfuran), poly(vinylphosphonic acid), poly(4-vinylbenzenephosphonic acid), poly(vinylphosphinic acid), poly(4-vinylbenzenesulfinic acid), poly(vinylphosphoric acid), poly(vinylsulfonic acid), poly(4-vinylbenzenesulfonic acid), poly(vinylsulfinic acid), poly(4-vinylbenzenearsonic acid), poly(4-vinylphenylselenic acid), or poly(itaconic acid); and wherein the non-Zwitter ion neutralized salt containing polar A' blocks or segments are poly(sodium methacrylate or acrylate), poly(zirconium methacrylate or acrylate), poly(potassium methacrylate or acrylate), poly(lithium methacrylate or acrylate), poly(calcium methacrylate or acrylate), poly(barium methacrylate or acrylate), poly(aluminum methacrylate or acrylate), poly(iron methacrylate or acrylate), poly(manganese methacrylate or acrylate), poly(triethylammonium methacrylate or acrylate or 4-vinylbenzenephophonate), poly(1,8-bis-(dimethylammonium-naphthalene methacrylate or acrylate or itaconate), poly(tetrabutylammonium methacrylate or acrylate or 4-vinylbenzene sulfonate) wherein the A block and the A' block each have a number average molecular weight range of from about 200 to about 120,000 and the B block has a number average molecular weight range of from about 2,000 to 190,000; and a charge adjuvant.

4. A developer in accordance with claim 3 wherein the charge director is poly[N,N-dimethylammoniumethyl methacrylate bromide (A block) co-2-ethylhexyl methacrylate (B block)-co-methacrylic acid (A' block)], poly[N,N,N-trimethylammoniumethyl methacrylatebromide (A block)-co-2-ethylhexyl methacrylate (B block)-co-methacrylic acid (A' block)], poly[2-ethylhexyl methacrylate (B block)-co-N,N-dimethylammoniumethyl methacrylate tosylate (A block)-co-methacrylic acid (A' block)], poly[2-ethylhexyl methacrylate (B block)-co-N,N-dimethylammoniumethyl methacrylate bromide (A block)-co-itaconic acid (A' block)], poly[2-ethylhexyl methacrylate (B block)-co-N,N-dimethylammoniumethyl methacrylate bromide (A block)-co-acrylic acid (A' block)], poly[2-ethylhexyl methacrylate (B block)-co-N,N-dimethylammoniumethyl methacrylate chloride (A block)-co-methacrylic acid (A' block)], poly[N,N-dibutyl methacrylamide (B block)-co-N,N-dimethylammoniumethyl methacrylate bromide (A block)-co-methacrylic acid (A' block)], poly[N,N-dibutyl methacrylamide (B block)-co-N,N-dimethylammoniumethyl methacrylate bromide (A block)-co-acrylic acid (A' block)], poly[2-ethylhexyl methacrylate (B block)-co-4-vinyl-N,N-dimethylanilinium bromide (A block)-co-methacrylic acid (A' block)], poly[2-ethylhexyl methacrylate (B block)-co-N,N-dimethylammoniumethylene bromide (A block)-co-methacrylic acid (A' block)], poly[2-ethylhexyl methacrylate (B block)-co-N,N-dimethylammoniumpropylene bromide (A block)-co-methacrylic acid (A' block)], poly[lauryl methacrylate (B block)-co-N,N,N-trimethylammoniumethyl methacrylate bromide (A block)-co-methacrylic acid (A' block)], poly [lauryl methacrylate (B block)-co-N,N-dimethylammoniumethyl methacrylate bromide (A block)-co-methacrylic acid (A' block)], poly[2-ethylhexyl methacrylate (B block)-co-N,N,N-trimethylammoniumethyl methacrylate chloride (A block)-co-methacrylic acid (A' block)], poly[2-ethylhexyl methacrylate (B block)-co-N,N-dimethylammoniumethyl methacrylate chloride (A block)-co-methacrylic acid (A' block)], poly[2-ethylhexyl methacrylate (B block)-co-N,N,N-trimethylammoniumethyl methacrylate phosphate (A block)-co-methacrylic acid (A' block)], poly[2-ethylhexyl methacrylate (B block)-co-N,N,N-trimethylammoniumethyl methacrylate sulfate (A block)-co-methacrylic acid (A' block)], poly[2-ethylhexyl methacrylate (B block)-co-N,N-dimethylammoniumethyl methacrylate sulfate (A block)-co-methacrylic acid (A' block)], poly[4-vinyl-N-pyridinium bromide (A block)-co-methacrylic acid (A' block)-co-2-ethylhexyl methacrylate (B block)], poly[4 -vinyl-N-pyridinium bromide (A block)-co-itaconic acid (A' block)-co-2-ethylhexyl methacrylate (B block)], poly[4-vinyl-N-pyridinium bromide (A block)-co-4-vinylbenzenesulfonic acid (A' block)-co-2-ethylhexyl methacrylate (B block)], poly[4-vinyl-N-pyridinium bromide (A block)-co-4-vinylbenzenephosphonic acid (A' block)-co-2-ethylhexyl methacrylate (B block)], poly[4-vinyl-N-pyridinium bromide (A block)-co-4-vinylbenzenephosphinic acid (A' block)-co-2-ethylhexyl methacrylate (B block)], poly[4-vinyl-N-pyridinium bromide (A block)-co-4-vinylbenzenearsonic acid (A' block)-co-2-ethylhexyl methacrylate (B block)], poly[4-vinyl-N-pyridinium bromide (A block)-co-4-vinylbenzeneselenic acid (A' block)-co-2-ethylhexyl methacrylate (B block)], or poly[4-vinyl-N-pyridinium bromide (A block)-co-methacrylic acid (A' block)-co-p-tertiary butylstyrene (B block)].

5. A liquid electrostatographic developer in accordance with claim 2 wherein said liquid is a nonpolar liquid with a Kauri-butanol value of from about 5 to about 30 weight percent, and is present in a major amount of from about 50 percent to about 95 weight percent.

6. A developer in accordance with claim 3 wherein the A block is an alkyl, aryl or alkylaryl ammonium containing polymer wherein alkyl, aryl, or alkylaryl moiety can be optionally substituted or unsubstituted, which A blocks are obtained from the monomers N,N-dimethylamino-N-2-ethyl methacrylate, N,N-diethylamino-N-2-ethyl methacrylate, N,N-dimethylamino-N-2-ethyl acrylate, N,N-diethylamino-N-2-ethyl acrylate, N,N-morpholino-N-2-ethyl methacrylate, N,N-morpholino-N- 2-ethyl acrylate, 4-vinylpyridine, 2-vinyl pyridine; and wherein said B blocks are obtained from the monomers 2-ethylhexyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, myrcene, piperylene, 1-dodecene, 4-tertiary butylstyrene, or 3-tertiary butylstyrene.

7. A developer in accordance with claim 2 wherein the charge adjuvant is hydroxy bis[3,5-di-t-butyl salicylic]aluminate monohydrate or aluminum stearate.

8. A developer in accordance with claim 2 wherein the resin particles are comprised of a copolymer of acrylic acid and methacrylic acid.

9. A developer in accordance with claim 2 wherein the resin particles are comprised of a styrene polymer, an acrylate polymer, a methacrylate polymer, a polyester, or mixtures thereof.

10. A developer in accordance with claim 3 wherein the resin particles are comprised of a copolymer of ethylene and vinyl acetate, polypropylene, polyethylene, acrylic polymers, or mixtures thereof.

11. A developer in accordance with claim 3 wherein the resin particles are comprised of a copolymer of ethylene and acrylic acid, or methacrylic acid, a copolymer of ethylene and alkyl ester of acrylic, or methacrylic acid wherein alkyl contains from 1 to about 5 carbon atoms, or a copolymer of ethylene and methacrylic acid with a melt index at 190° C. of 500.

12. A developer in accordance with claim 2 wherein the pigment is selected from the group consisting of cyan, magenta, yellow, red, green, blue, brown, carbon black, and mixtures thereof.

13. A developer in accordance with claim 2 wherein the charge director is present in an amount of from about 0.1 to about 100 weight percent by weight of the developer solids comprised of resin particles, pigment, and charge adjuvant; and there is enabled a negatively charged developer.

14. A developer in accordance with claim 3 wherein the charge director is present in an amount of from about 2.0 to about 20 weight percent based on the developer solids comprised of resin particles, pigment, and charge adjuvant and there is enabled a negatively charged developer.

15. A developer in accordance with claim 2 wherein the liquid is an aliphatic hydrocarbon.

16. A developer in accordance with claim 15 wherein the aliphatic hydrocarbon is a mixture of branched hydrocarbons with from about 12 to about 16 carbon atoms.

17. An imaging method which comprises forming an electrostatic latent image followed by the development thereof with the liquid developer of claim 1.

18. An imaging method which comprises forming an electrostatic latent image followed by the development thereof with the liquid developer of claim 3.

19. A liquid developer in accordance with claim 2 wherein the nonpolar B blocks or segments are poly(2-ethylhexyl methacrylate), poly(2-ethylhexyl acrylate), poly(lauryl methacrylate), poly(lauryl acrylate), poly(tertiary butyl styrene), poly(myrcene), or poly(N,N-dibutylmethacrylamide), and wherein the polar A block or segment alkylated ammonium cationic repeat unit components of the inter-repeat unit Zwitter ions are poly(N,N,N-trimethylammoniumethyl methacrylate), poly(N,N,N-trimethylammoniumethyl acrylate), poly(N,N,N-triethylammoniumethyl methacrylate), poly(N,N,N-triethylammoniumethyl acrylate), poly(2,3, or 4-vinyl-N-methylpyridinium) or poly(2,3, or 4-vinyl-N-butylpyridinium), and wherein the polar A' block or segment conjugate acid anionic repeat unit components of the inter-repeat unit Zwitter ions are poly(methacrylate), poly(acrylate), poly(4-vinylbenzoate), poly(4-vinyl-1-naphthoate), poly(5-vinyl-2-thiophene carboxylate), poly(5-vinyl-2-furan carboxylate), poly(vinylphosphonate), poly(4-vinylbenzenephosphonate), poly(vinylphosphinate), poly(4-vinylbenzenesulfinate), poly(vinylphosphorate), poly(vinylsulfonate), poly(4-vinylbenzenesulfonate), poly(vinylsulfinate), poly(4-vinylbenzenearsonate), poly(4-vinylphenylselenate), or poly(itaconate) wherein the A block and the A' block each have a number average molecular weight range of from about 200 to about 120,000, and the B block has a number average molecular weight range of from about 2,000 to about 190,000.

20. A developer in accordance with claim 19 wherein the charge director is poly[N,N,N-trimethyl-2-ammoniumethyl methacrylate (A block-ZI cation)-co-2-ethylhexyl methacrylate (B block)-co-methacrylate (A' block-ZI anion)-co-sodium methacrylate (A' block-free acid)], poly[N,N,N-trimethyl- 2-ammoniumethyl methacrylate (A block-ZI cation)-co-2-ethylhexyl methacrylate (B block)-co-methacrylate (A' block-ZI anion)-co-sodium methacrylate (A' block-neutral salt)-co-methacrylic acid (A' block-free acid)], poly[N,N,N-trimethyl-2-ammoniumethyl methacrylate bromide (A block-alkyl ammonium quat)-co-N,N,N-trimethyl-2-ammoniumethyl methacrylate (A block-ZI cation)-co-2-ethylhexyl methacrylate (B block)-co-methacrylate (A' block-ZI anion)-co-methacrylic acid (A' block-free acid)], poly[N,N,N-trimethyl-2-ammoniumethyl (A block-ZI cation)/methacrylate (A' block-ZI anion)-co-2-ethylhexyl methacrylate (B block)], poly[2-ethylhexyl methacrylate (B block)-co-N,N,N-trimethyl-2-ammoniumethyl methacrylate (A block-ZI cation)/4-vinylbenzoate (A' block-ZI anion)], poly[2-ethylhexyl methacrylate (B block)-co-N,N,N-trimethyl-2-ammoniumethyl methacrylate (A block-ZI cation)/4-vinylbenzenesulfonate (A' block-ZI anion)], poly[2-ethylhexyl methacrylate (B block)-co-N,N,N-trimethyl- 2-ammoniumethyl methacrylate (A block-ZI cation)/4-vinylbenzenesulfinate (A' block-ZI anion)], poly[2-ethylhexyl methacrylate (B block)-co-N,N,N-trimethyl-2-ammoniumethyl methacrylate (A block-ZI cation)/4-vinylbenzenephosphonate (A' block-ZI anion)], poly[2-ethylhexyl methacrylate (B block)-co-N,N,N-trimethyl-2-ammoniumethyl methacrylate (A block-ZI cation)/4-vinylbenzenearsonate (A' block-ZI anion)], poly[2-ethylhexyl methacrylate (B block)-co-N,N,N-trimethyl-2-ammoniumethyl methacrylate (A block-ZI cation)/4-vinylbenzeneselenate (A' block-ZI anion)], poly [2-ethylhexyl methacrylate (B block)-co-N,N,N-trimethyl-2-ammoniumethyl methacrylate (A block-ZI cation)/itaconate (A' block-ZI anion)], poly[4-vinyl-N-methylpyridinium (A block-ZI cation)-co-methacrylate (A' block-ZI anion)-co-2-ethylhexyl methacrylate (B block)], poly[4-vinyl-N-methylpyridinium (A block-ZI cation)-co-itaconate (A' block-ZI anion)-co-2-ethylhexyl methacrylate (B block)], poly[4-vinyl-N-methylpyridinium (A block-ZI cation)-co-4-vinylbenzenesulfonate (A' block-ZI anion)-co-2-ethylhexyl methacrylate (B block)], poly[4-vinyl-N-methylpyridinium (A block-ZI cation)-co-4-vinylbenzenephosphonate (A' block-ZI anion)-co-2-ethylhexyl methacrylate (B block)], poly[4-vinyl-N-methylpyridinium (A block-ZI cation)-co-4-vinylbenzenephosphinate (A' block-ZI anion)-co-2-ethylhexyl methacrylate (B block)], poly[4-vinyl-N-methylpyridinium (A block-ZI cation)-co-4-vinylbenzenearsonate (A' block-ZI anion)-co-2-ethylhexyl methacrylate (B block)], poly[4-vinyl-N-methylpyridinium (A block-ZI cation)-co-4-vinylbenzeneselenate (A' block-ZI anion)-co-2-ethylhexyl methacrylate (B block)], poly[4-vinyl-N-methylpyridinium (A block-ZI cation)-co-methacrylate (A' block-ZI anion)-co-p-tertiary butylstyrene (B block)], poly[4-vinyl-N-benzylpyridinium (A block-ZI cation)-co-methacrylate (A' block-ZI anion)-co-2-ethylhexyl methacrylate (B block)], poly[4-vinyl-N-benzylpyridinium (A block-ZI cation)-co-4-vinylbenzenephosphonate (A' block-ZI anion)-co-2-ethylhexyl methacrylate (B block)], poly[4-vinyl-N-ethyleneoxyethylpyridinium (A block-ZI cation)-co-4-vinylbenzenesulfonate (A' block-ZI anion)-co-2-ethylhexyl methacrylate (B block)], poly[4-vinyl-N-ethylpyridinium (A block-ZI cation)-co-methacrylate (A' block-ZI anion)-co-p-tertiary butylstyrene (B block)], poly[4-vinyl-N-ethylpyridinium (A block-ZI cation)-co-4-vinylbenzenearsonate (A' block-ZI anion)-co-2-ethylhexyl methacrylate (B block)], poly[4-vinyl-N-isobutylpyridinium (A block-ZI cation)-co-itaconate (A' block-ZI anion)-co-2-ethylhexyl methacrylate (B block)], poly[N,N-dibutylmethacrylamide-co-N,N,N-trimethyl- 2-ammoniumethyl methacrylate (A block-ZI cation)/methacrylate (A' block-ZI anion)], poly[N,N-dibutylmethacrylamide-co-N,N,N-trimethyl-2-ammoniumethyl methacrylate (A block-ZI cation)/itaconate (A' block-ZI anion)], poly[N,N-dibutylmethacrylamide-co-N,N,N-trimethyl- 2-ammoniumethyl methacrylate (A block-ZI cation)/4-vinylbenzenesulfonate (A' block-ZI anion)], poly[N,N-dibutylmethacrylamido-co-N,N,N-trimethyl-2-ammoniumethyl methacrylate (A block-Zl cation)/4-vinylbenzenephosphonate (A' block-ZI anion)], poly[N,N-dibutylmethacrylamide-co-N,N,N-trimethyl-2-ammoniumethyl methacrylate (A block-ZI cation)/4-vinylbenzenearsonate (A' block-ZI anion)], or poly[N,N-dibutylmethacrylamide-co-N,N,N-trimethyl-2-ammoniumethyl methacrylate (A block-ZI cation)/4-vinylbenzeneselenate (A' block-ZI anion)].

21. A developer in accordance with claim 4 wherein the pigment is carbon black, cyan, magenta, yellow or mixtures thereof.

* * * * *